US011751670B2

(12) United States Patent
Graham et al.

(10) Patent No.: US 11,751,670 B2
(45) Date of Patent: Sep. 12, 2023

(54) CHILD CARRIER, BAG, BACKPACK, AND ALTERABLE FRAME

(71) Applicant: Osprey Packs, Inc., Cortez, CO (US)

(72) Inventors: Christopher John Graham, Kendal (GB); Le Nhu Quynh, Ho Chi Minh (VN)

(73) Assignee: Osprey Packs, Inc., Cortez, CO (US)

( * ) Notice: Subject to any disclaimer, the term of this patent is extended or adjusted under 35 U.S.C. 154(b) by 218 days.

(21) Appl. No.: 17/344,785

(22) Filed: Jun. 10, 2021

(65) Prior Publication Data

US 2021/0393011 A1 Dec. 23, 2021

Related U.S. Application Data

(60) Provisional application No. 63/041,590, filed on Jun. 19, 2020.

(51) Int. Cl.

| | |
|---|---|
| ***A45C 13/04*** | (2006.01) |
| ***A45C 7/00*** | (2006.01) |
| ***A45F 3/04*** | (2006.01) |
| ***A47D 13/02*** | (2006.01) |

(52) U.S. Cl.

CPC ..... *A45C 13/04* (2013.01); *A45C 7/0036* (2013.01); *A45F 3/04* (2013.01); *A47D 13/025* (2013.01)

(58) Field of Classification Search

CPC ..... A45C 13/04; A45C 7/0036; A45F 3/04; A45F 4/02; A47D 13/025

USPC ..... 190/107

See application file for complete search history.

(56) References Cited

U.S. PATENT DOCUMENTS

| | | | | | |
|---|---|---|---|---|---|
| 1,039,078 | A * | 9/1912 | Arnold | A47C 4/52 | 297/23 |
| 1,155,475 | A * | 10/1915 | Fay | B65D 37/00 | 220/9.3 |
| 1,533,636 | A * | 4/1925 | Day | A45C 7/0077 | 5/99.1 |
| 2,806,563 | A * | 9/1957 | Einhorn | A45C 7/0036 | 190/107 |
| 3,613,843 | A * | 10/1971 | Davis | A45C 3/004 | 190/126 |
| 3,989,173 | A | 11/1976 | Gebhard | | |
| 4,718,715 | A | 1/1988 | Ho | | |
| 4,955,517 | A * | 9/1990 | Maresca | A45F 4/02 | 297/229 |

(Continued)

FOREIGN PATENT DOCUMENTS

WO WO-2017032998 A1 * 3/2017 ..... A45C 13/005

OTHER PUBLICATIONS

European Search Report filed in EP21180125 dated Mar. 11, 2022.

*Primary Examiner* — John K Fristoe, Jr.
*Assistant Examiner* — Justin Caudill
(74) *Attorney, Agent, or Firm* — RANKIN, HILL & CLARK LLP

(57) ABSTRACT

Child carriers, backpacks, bags, and alterable frames assemblies that resist buckling or breaking when an excessive force is applied. Frame members may move until engagement member engage when expanding the frame assembly. A fabric body may allow for movement of frame members, limit such movement, and support & strengthen the frame members within sleeves. The frame members include U-shaped and inverted U-shaped frame members engaging at engagement member when the frame is uncollapsed.

15 Claims, 13 Drawing Sheets

(56) References Cited

U.S. PATENT DOCUMENTS

| | | | | |
|---|---|---|---|---|
| 5,178,245 | A * | 1/1993 | Cox | A45C 7/0036 190/123 |
| 5,350,241 | A * | 9/1994 | Zoland | A45C 13/004 383/33 |
| 5,562,204 | A * | 10/1996 | Sapyta | A45C 13/02 190/110 |
| 6,378,892 | B1 | 4/2002 | Hsia | |
| 7,118,172 | B1 | 10/2006 | Pattison-Sheets | |
| 7,624,887 | B2 * | 12/2009 | Avery | B65D 25/16 220/9.4 |
| 9,308,928 | B2 * | 4/2016 | Thorpe | B62B 5/067 |
| 10,098,431 | B2 * | 10/2018 | Davis | A45C 7/0036 |
| 10,653,107 | B2 * | 5/2020 | Nelson | A01K 1/0125 |
| 2005/0051404 | A1 * | 3/2005 | Chi | A45C 7/0036 190/107 |
| 2007/0278768 | A1 * | 12/2007 | Lynam | B62B 3/027 280/651 |
| 2008/0289925 | A1 * | 11/2008 | Sapyta | A45C 7/0054 190/18 A |
| 2011/0083933 | A1 * | 4/2011 | Engel | A45C 7/0077 190/107 |
| 2011/0162931 | A1 * | 7/2011 | Collins | A45C 7/0063 190/103 |
| 2014/0202897 | A1 * | 7/2014 | Collins | A45C 3/001 206/315.1 |
| 2015/0305295 | A1 * | 10/2015 | Frankel | B65D 37/00 220/6 |
| 2016/0270496 | A1 * | 9/2016 | Pitchforth | B62B 1/12 |
| 2019/0183258 | A1 | 6/2019 | Chatzidakis | |

* cited by examiner

CHILD CARRIER, BAG, BACKPACK, AND ALTERABLE FRAME

FIELD THE INVENTION

Various embodiments of the technology disclosed in the present application relate to child carriers, backpacks, and bags. Child carriers may be used to carry a child and items on a person's back. Some embodiments disclosed herein relate to collapsible or alterable frames for such times.

BACKGROUND OF THE INVENTION

Child carriers, backpacks, luggage, and bags have been designed and used. Backpacks have been used to carry items on a person's back. Child carriers have been used to carry children and items on a person's back, and sometimes on a person's chest. In the past, some backpacks and child carriers have had fabric bodies with frames to provide structural support and strength. Such frames have been made from aluminum or other metal tubing to provide stiffness, strength, and light weight. In other instances, the frames may have members formed from plastics or composites.

Frames have been at least partially collapsible and have used hinges or pins to provide attachment and allow relative movement of different frame members. In child carriers, frames have allowed the apparatus to stand up on a surface. The frames, however, were susceptible to damage at the hinge or pin with excessive force. An example of an excessive force is a downward force on the top of the apparatus when the apparatus is standing up that causes damage. Another example of an excessive force is the force associated with setting the device down too hard when uncollapsed. In the prior art, such an excessive force would typically break or buckle the frame, potentially rendering the apparatus unsafe or unusable.

Room for improvement exists over the prior art. Needs or potential areas for benefit exist for apparatuses that include frames that are alterable or collapsible, that do not break or do not buckle when an excessive force is applied (e.g., at least for certain categories of excessive force), or a combination thereof. Further, needs or potential areas for benefit exist for apparatuses that are light weight, strong, damage resistant, or a combination thereof. Needs or potential areas for benefit exist in these areas individually as well as in various combinations of these areas. Moreover, room for improvement exists over the prior art in the design of alterable frames generally as well as in specific applications. Potential for benefit or improvement exists in these and other areas that may be apparent to a person of skill in the art having studied this document.

SUMMARY OF PARTICULAR EMBODIMENTS OF THE INVENTION

Various embodiments are or include child carriers, backpacks, bags, luggage, and methods of making such products. Further, various backpacks, for instance, can be used to carry items on a person's back, for example, while hiking, backpacking, mountaineering, canyoneering, mountain biking, rock climbing, skiing, traveling, or going to and from school (or between classes), as examples. Still further, child carriers can be used (e.g., by an adult) to carry a child, for example, while hiking, backpacking, or traveling, as examples. Various embodiments at least partially address one or more of the needs or potential areas for benefit or improvement that are described herein. Further, some embodiments provide, for example, as a benefit, a reduction in weight, an improvement in strength or damage resistance, or a combination thereof, for example. Improvements may exist in these areas individually as well as in various combinations of these areas, as further examples. Other areas for benefit or improvement may be apparent to a person of skill in the art having studied this document. Various embodiments of the invention are specifically described herein, and other embodiments may be apparent to a person of skill in this area of technology.

BRIEF DESCRIPTION OF THE DRAWINGS

The drawings provided herewith illustrate, among other things, examples of certain aspects of particular embodiments. Other embodiments may differ. Some embodiments include a portion of the components illustrated. Further, various embodiments may include aspects shown in the drawings, described in the specification (including the claims), known in the art, or a combination thereof, as examples.

DESCRIPTION

This patent application describes, among other things, examples of certain embodiments, and certain aspects of a frame that is configured for at least a collapsed position and an un-collapsed position. The frame may be referred to as a collapsible frame or an alterable frame, which terms are generally interchangeable herein. Other embodiments may differ from the particular examples described in detail herein. Various embodiments are or concern child carriers, backpacks, bags, and luggage, and apparatuses, for example, with alterable frames. Still further, various embodiments concern methods of making child carriers, backpacks, bags, luggage, and (e.g., alterable) frames, for example.

Figure 1:
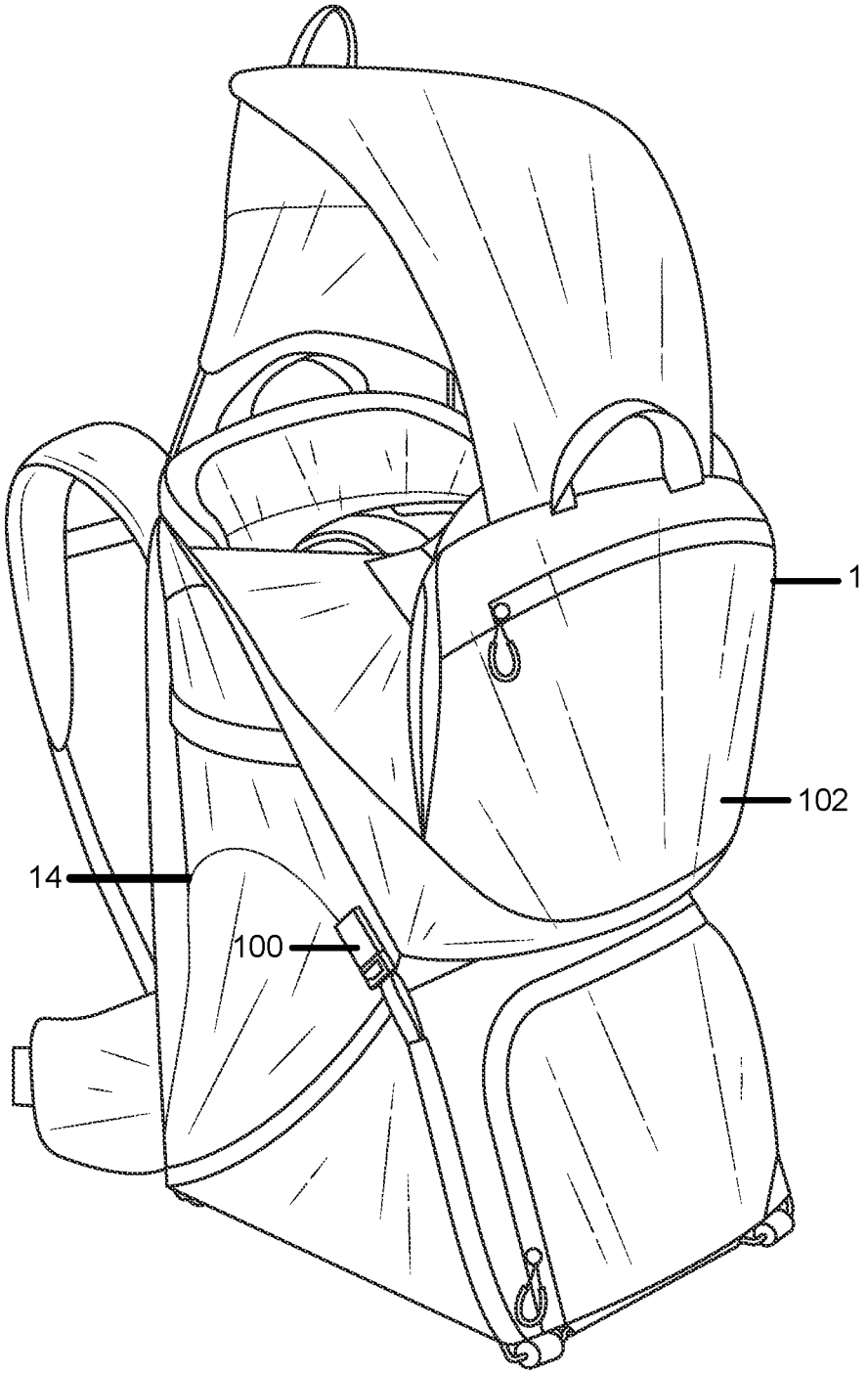
FIG. 1 is a view of a child carrier shown standing upright in an uncollapsed configuration consistent with the technology of the present application.
Figure 2:
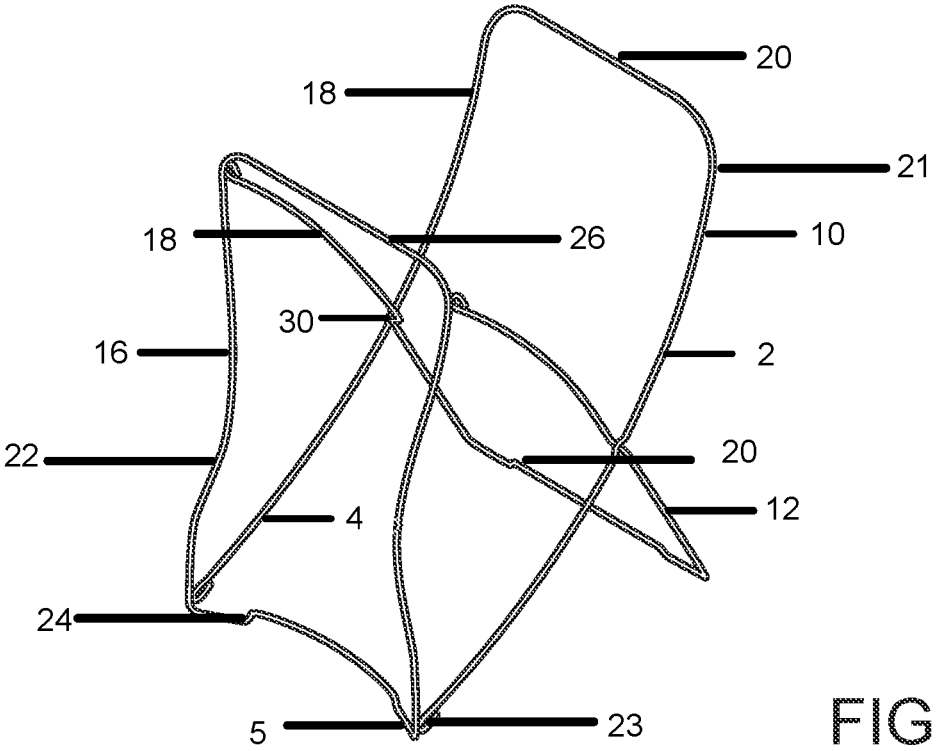
FIG. 2 is a drawing of an example of a frame of an apparatus consistent with the technology of the present application.
Figure 3:
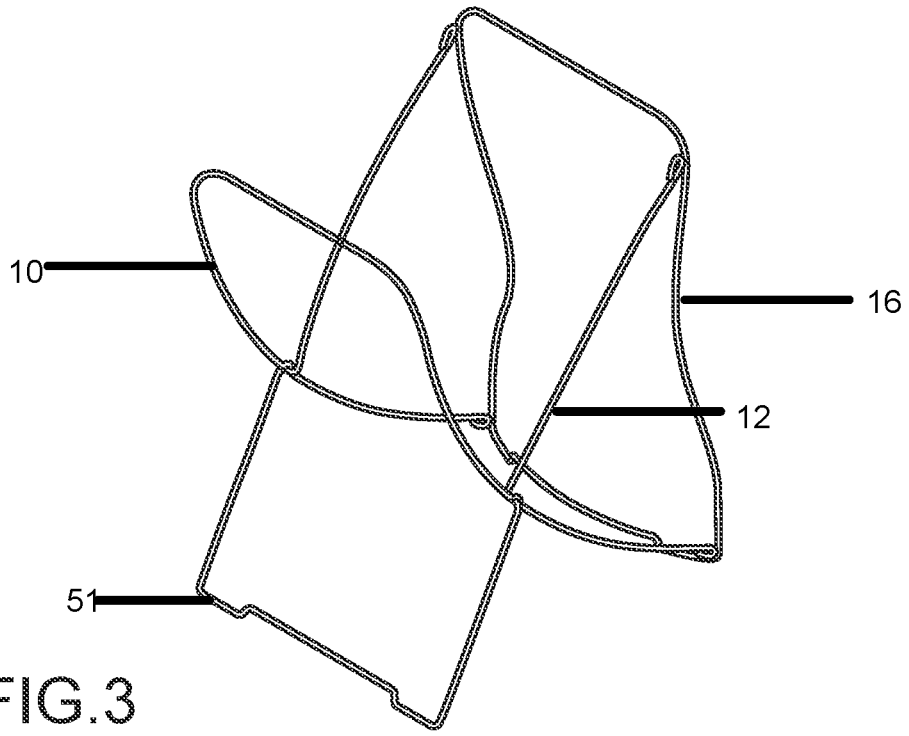
FIG. 3 is another drawing of the frame of FIG. 2.

Various embodiments of the technology described herein are described with respect to a child carrier. The technology, however, is not limited to frames for child carriers, but could be incorporated into other devices, such as, backpacks, bags, and luggage. The frames may resist buckling or breaking, for example, when an excessive force is applied. Frame members may move, for example, relative to each other, for instance, until engagement members engage. This may occur when expanding a frame. In a number of embodiments, a fabric body may allow for movement of frame members, limit such movement, support & strengthen the frame members, or a combination thereof. Frame members may be located within sleeves within the fabric body. Further, frame members may be formed from metals or composites. In certain embodiments, the frame members may be solid steel or stainless steel, as examples. In other embodiments, the frame members may be aluminum or hollow aluminum. In other embodiments, the frame members may be carbon based, fiberglass, or the like. Frame members may be curved, for example, to control direction of deformation, optimize support from the fabric body, or both. Still further, various bends in the frame members may form the engagement features, may join sections of the frame members, or both. Some embodiments include three frame members including a U-shaped frame member, such as frame member 12 in FIG. 2, and an inverted U-shaped frame member, such as frame member 10 in FIG. 2 that cross at the engagement members 30 in FIG. 2, for example, when the frame is uncollapsed. In a child carrier 1 as shown in FIG. 1, the collapsible frame members may be arranged or configured as shown in FIGS. 2 and 3. The two frame members 10 and 12 may form a three-dimensional structure 14 (FIG. 1) in which the child is suspended. In a number of embodiments, a third (e.g., rectangular) frame member 16 may provide vertical structure, for example, at the user's back. As shown in FIG. 1, the frame members 10, 12, and 16 may be internal to a fabric child carrier 1. In some instances, the fabric of the child carrier 1 may include channels to receive the tubular members of the frame members 10, 12, and 16. The child carrier may include buckles or the like secure the frame open in some embodiments. Even further still, in particular embodiments, a cover may zip over the harness for shipping. Weight and cost may be saved in comparison with alternative designs. The frame members 10, 12, and 16 are described herein with respect to a child carrier 1, but could be implemented in a backpack, luggage item, or the like. As shown in FIGS. 2 and 3, the frame members 10 and 12 are generally U-shaped (typically with one inverted with respect to the other) with longitudinally extending arms 18 and a transverse base 20 connecting one end 21 the arms 18. The terminal ends 23 of the arms 18 may terminate in a crimped member. The frame member 16 is generally vertical, relative to the angled frames 10 and 12. The frame member 16 has a pair of longitudinally extending arms 22 and a pair of transverse bases 24 and 26 connecting each end of the longitudinally extending arms 22.

Figure 7:
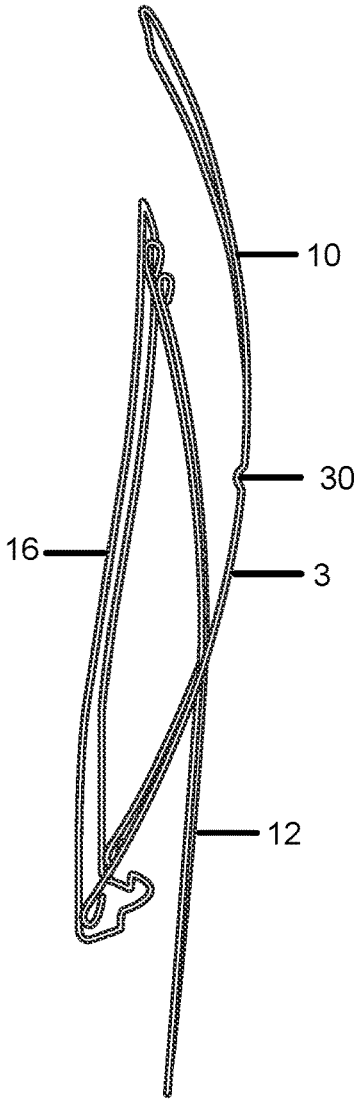
FIG. 7 is another drawing of the frame of FIG. 2.
Figure 8:
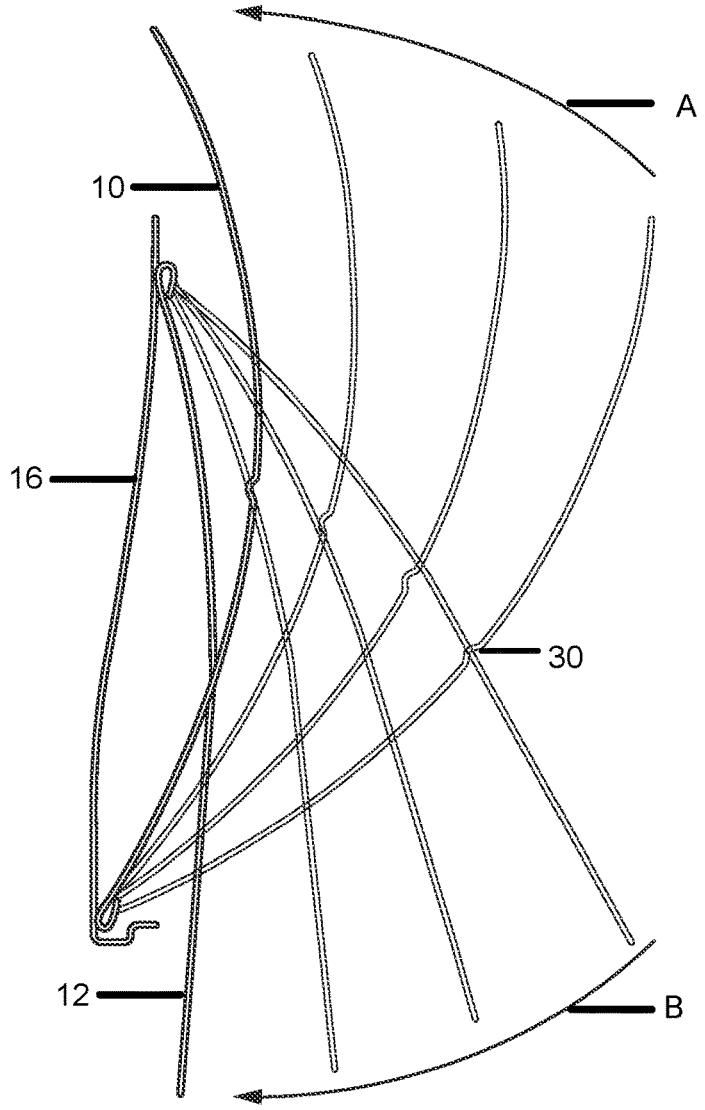
FIG. 8 is another drawing of the frame of FIG. 2.
Figure 9:
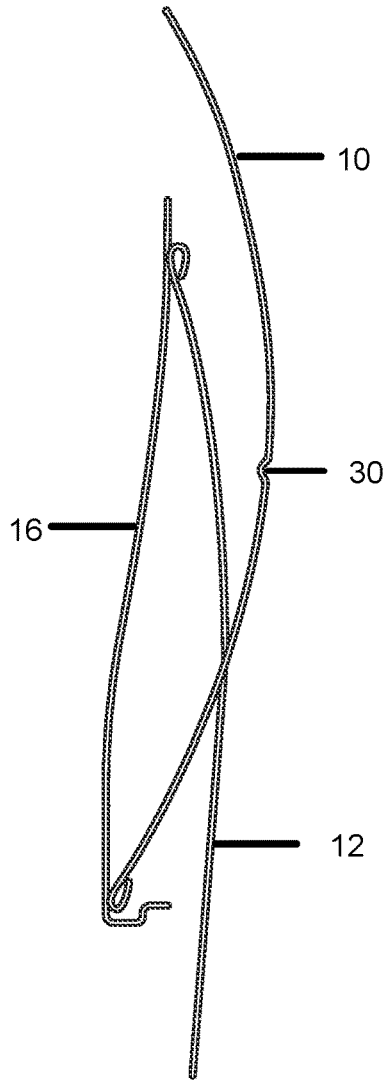
FIG. 9 is another drawing of the frame of FIG. 2.
Figure 10:
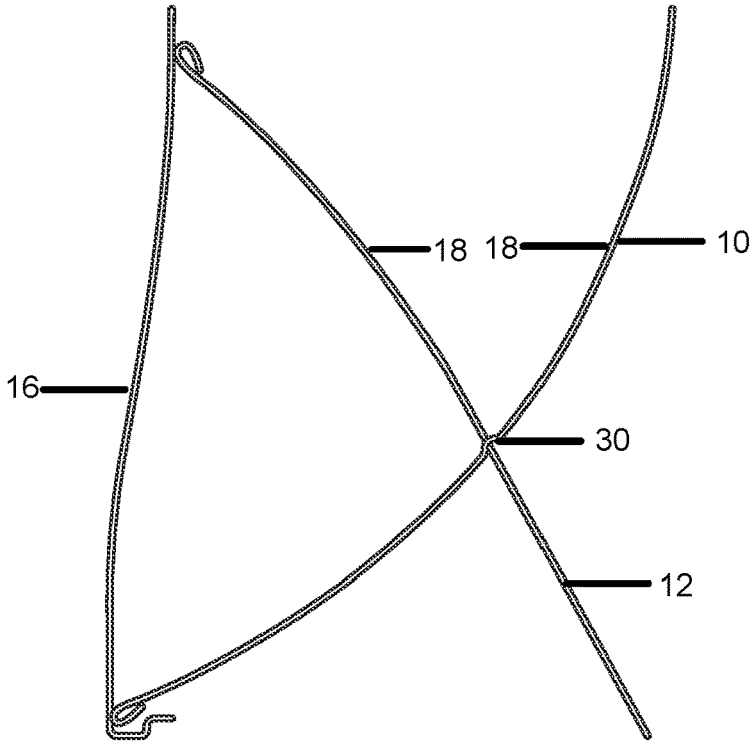
FIG. 10 is another drawing of the frame of FIG. 2.
Figure 11:
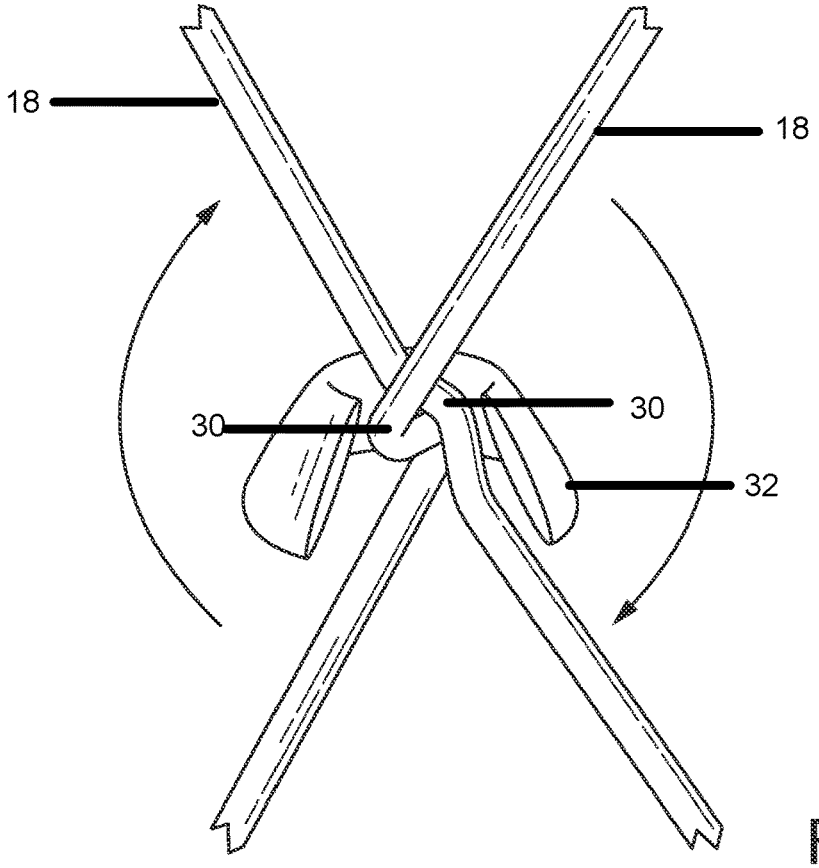
FIG. 11 is a figure of an engagement member consistent with the technology of the present application.
Figure 12:
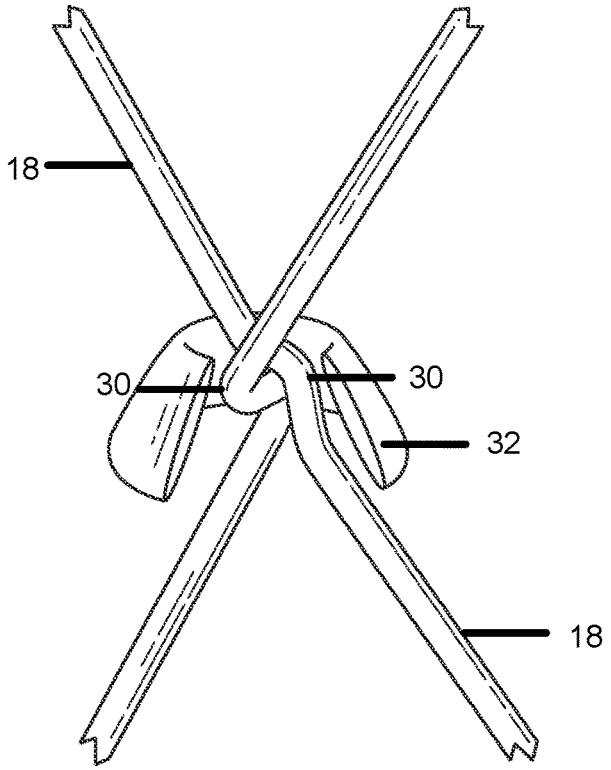
FIG. 12 is another drawing of the engagement member of FIG. 11.
Figure 13:
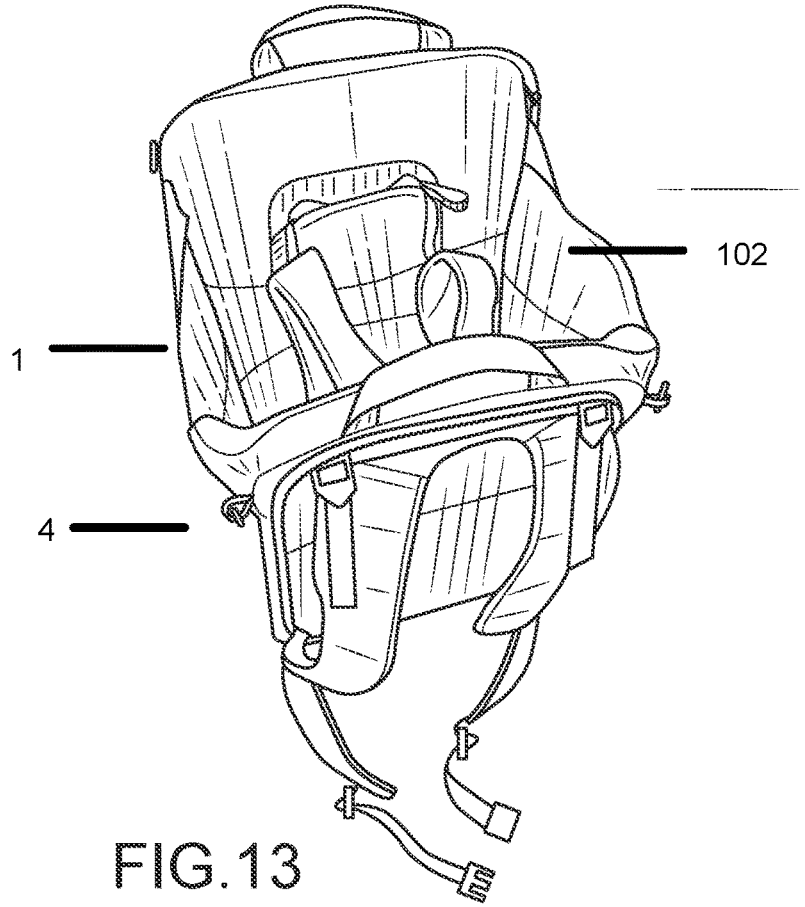
FIG. 13 is a figure of an uncollapsed child carrier implementing the frame of FIG. 2.
Figure 14:
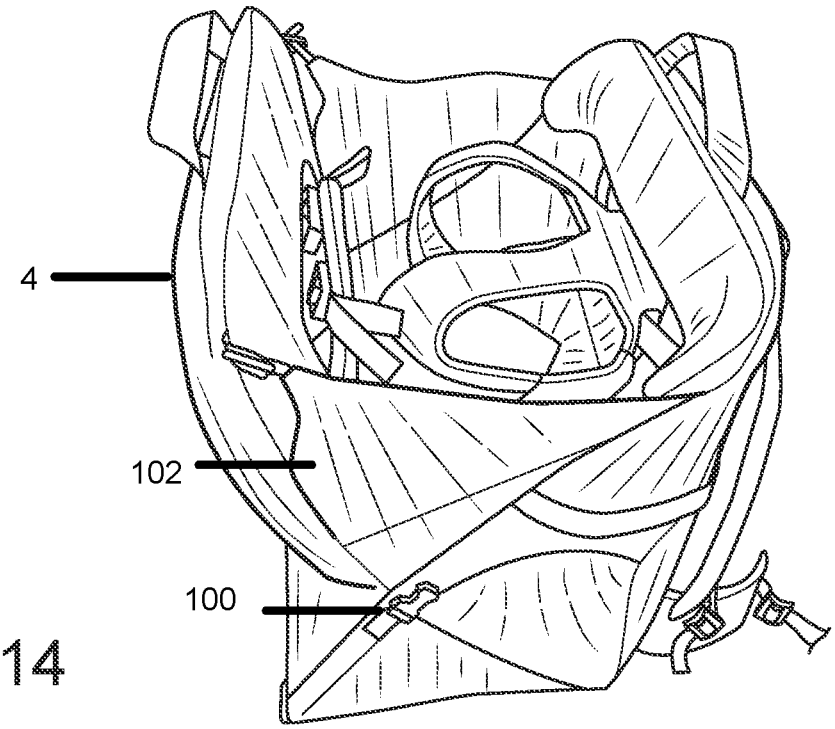
FIG. 14 is another view of the child carrier of FIG. 13.
Figure 15:
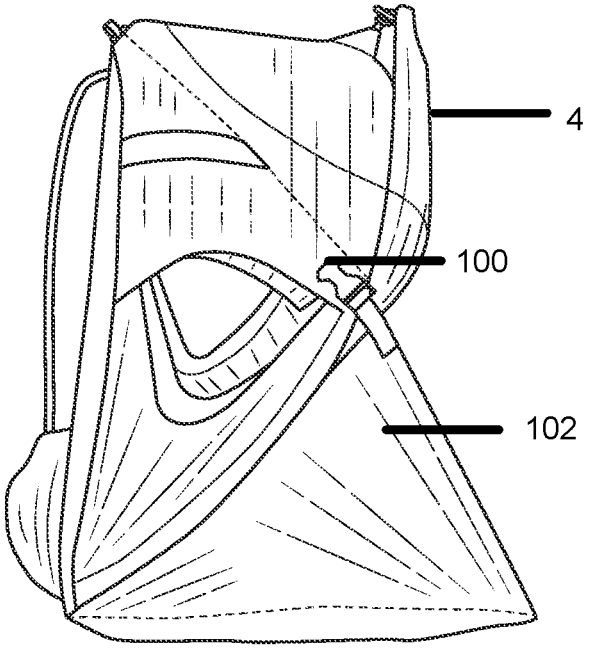
FIG. 15 is another view of the child carrier of FIG. 13.
Figure 16:
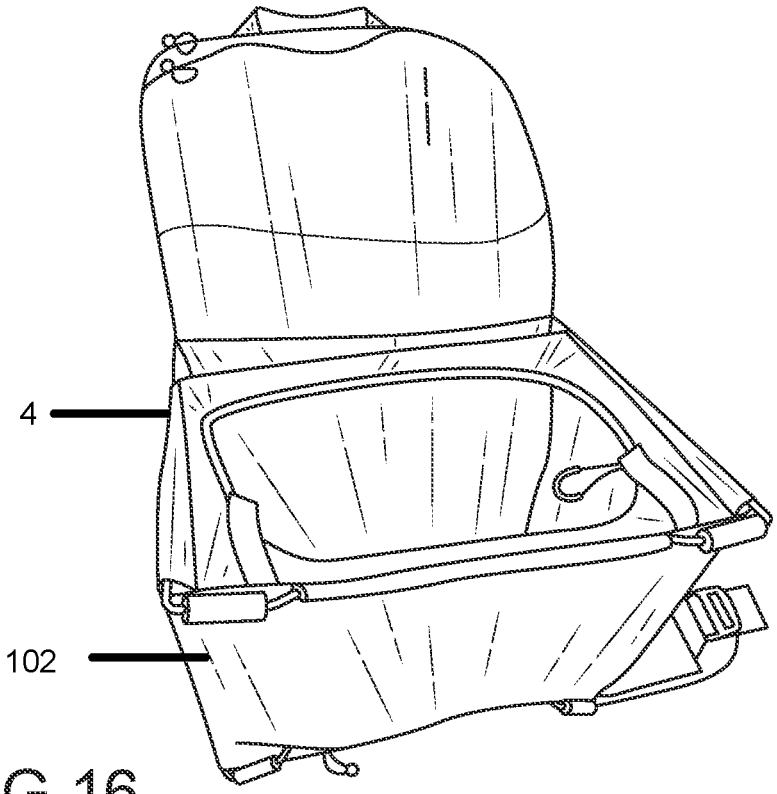
FIG. 16 is another view of the child carrier of FIG. 13.

Various embodiments are or include an apparatus, for example, for carrying items. In a number of embodiments, for instance, the apparatus includes a frame, for example, a collapsible frame. For example, in particular embodiments, the frame includes a first frame member, such as frame member 10 and a second frame member, such as frame member 12. Further, in some embodiments, the first frame member has a first engagement member 30 as shown in FIGS. 11 and 12. Also, the second frame member may have a second engagement member 30. The engagement member 30 optionally includes an engagement lock member 32 as shown in FIGS. 11 and 12. The frames 10 and 12 interconnecting at the first and second engagement members 30 (or just the first or just the second engagement member 30) provides point where a user may potentially pinch a finger. Thus, in certain embodiments, a pinch guard 32 may be used, which may be plastic, fabric, or metal, in place of or in combination with the engagement lock member 32. As shown in FIGS. 11 and 12, the engagement member 30 includes an elbow in the longitudinal arms 18 of the frame members 10 and 12. The arms 18 slide long each other until the elbows of the engagement members 30 meet, which forms a snap lock. The engagement lock member 32 is shown as a circular member that friction fits over the engagement members 30 to inhibit inadvertently releasing the engagement members 30. Still further, in particular embodiments, when the collapsible frame is expanded (e.g., by the user, for instance, from a collapsed configuration to an uncollapsed configuration), the first frame member moves relative to the second frame member as shown in FIG. 8. The frame members 10 and 12 move towards the frame member 16 in the directions shown by arrows A and B to collapse and would move in the opposite direction to uncollapse. Note, the terms uncollapsed and expanded may be used interchangibly herein. Even further, in some such embodiments, the first frame member moves relative to the second frame member until the first engagement feature engages the second engagement feature. As shown in FIG. 7, the frame members 10 and 12 are collapsed to frame member 16. The frame members 10 and 12 move relative to each other and frame member 16 such that the longitudinal arms 18 slide along one another until they engage at the engagement members 30, as shown in FIGS. 11 and 12. The frame members 10 and 12 may be biased such that when the engagement members 30 intersect, the frame members 10 and 12 form a snap lock. Once the engagement members 30 engage, forming a snap lock fitting, the engagement lock member 32 is moved, such as by rotation or sliding along the frame members, into place to hold the frame members in an uncollapsed configuration as shown in FIG. 10. In some embodiments, the engagement lock member 32 may be optional. Also, if a single engagement member 30 is used, the snap lock forms when the frame member, such as frame member 10's engagement member 30 slide to engage an arm 18 of frame member 12.

In a number of embodiments, the first engagement member 30 is formed by making at least one bend or elbow in the first frame member 10, the first engagement member 30 includes at least one bend in the first frame member, or both. Further, in some embodiments, the first engagement member is formed by making multiple bends or elbows in the first frame member, the first engagement member is formed by making bends in substantially opposite directions in the first frame member 10, the first engagement member is formed by making substantially adjacent (or adjacent) bends in the first frame member, or a combination thereof. Still further, in a number of embodiments, the second engagement member 30 is formed by making at least one bend or elbow in the second frame member 12, the second engagement member 30 includes at least one bend in the second frame member 12, or both. Even further, in various embodiments, the second engagement member is formed by making multiple bends or elbows in the second frame member, the second engagement member is formed by making bends in substantially opposite directions in the second frame, the second engagement member 30 is formed by making substantially adjacent (or adjacent) bends in the second frame member, or a combination thereof. Even further still, in particular embodiments, the second engagement member 30 is formed by making three bends in the second frame member. Having multiple engagement members 30 in the frame members 10 and 12 may allow for different settings on the child carrier such that the opening, in which the child is fitted, may be alterable in size in the uncollapsed configuration.

Figure 6:
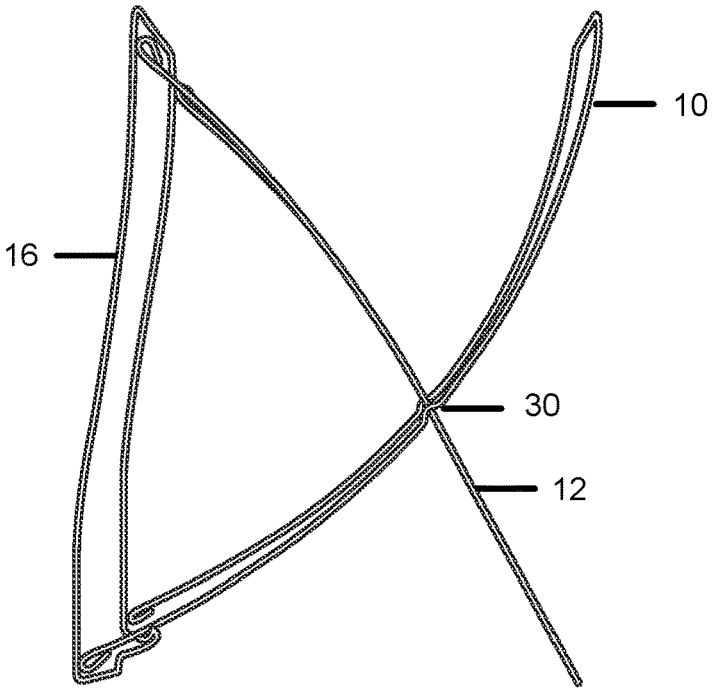
FIG. 6 is another drawing of the frame of FIG. 2.

Further, in some embodiments, an apparatus for carrying items, such as the child carrier 1, includes a collapsible frame that includes a first frame member 10 and a second frame member 12 and when the collapsible frame is expanded (e.g., from a collapsed configuration to an uncollapsed configuration), the second frame member 12 slides against the first frame member 10, or at least the longitudinal arms 18 slide relative to each other. Still further, in some such embodiments, the first frame member 10 has a first engagement member 30 and when the collapsible frame is expanded (e.g., from the collapsed configuration to the uncollapsed configuration), the second frame member 12 moves relative to the first frame member 10, for instance, until the first engagement member 30 engages the second frame member 12. In this instance, which is shown in FIG. 6, only the first frame member 10 has an engagement member 30. Further still, in some such embodiments, the second frame member 12 has a second engagement member 30 and when the collapsible frame is expanded (e.g., from the collapsed configuration to the uncollapsed configuration), the second frame member 12 moves relative to the first frame member 10, until the first engagement member 30 engages the second engagement member 30.

Figure 4:
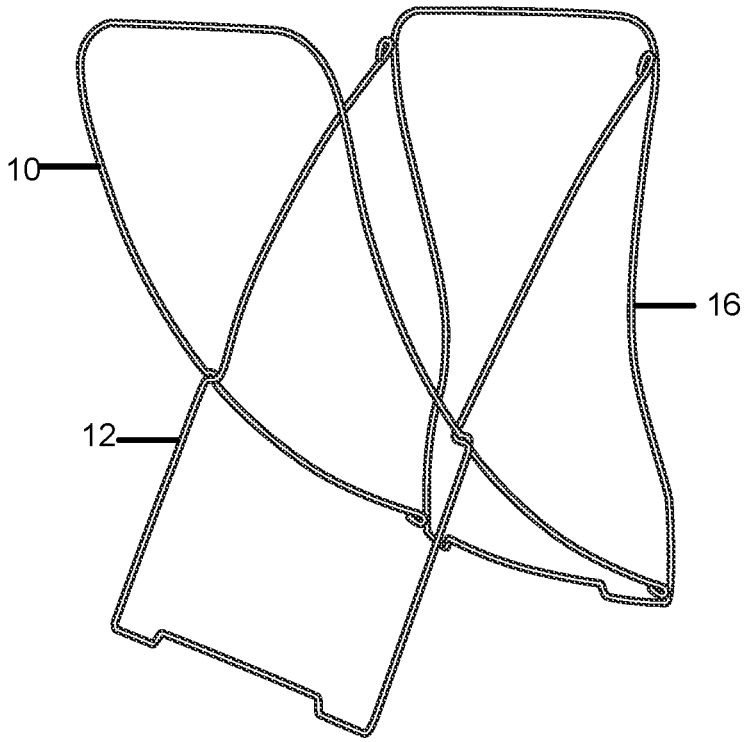
FIG. 4 is another drawing of the frame of FIG. 2.
Figure 5:
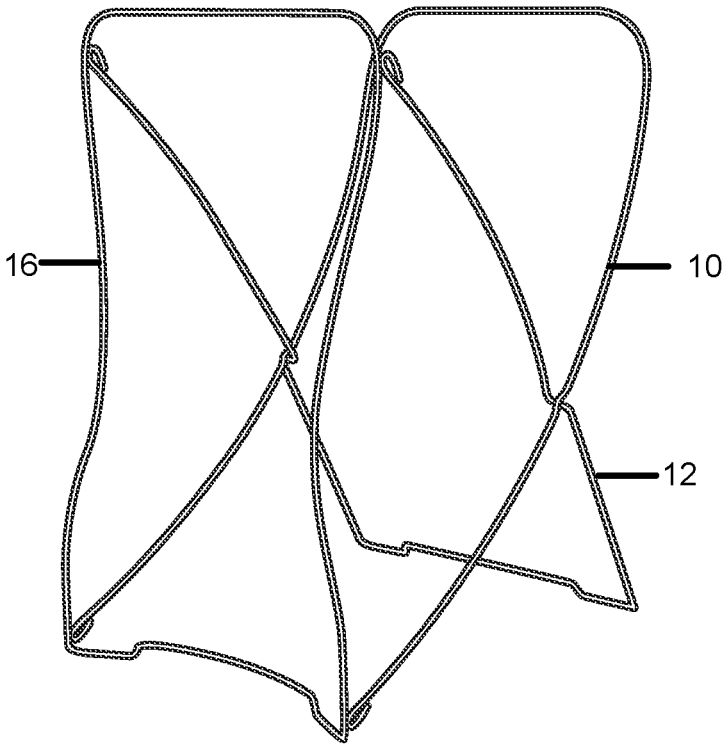
FIG. 5 is another drawing of the frame of FIG. 2.

More broadly, in various embodiments, an apparatus includes an alterable frame assembly, such as alterable frame assembly 2 shown in FIG. 2. In some such embodiments, for example, the (e.g., alterable) frame includes a first frame member 10 (e.g., having a first engagement member 30) and a second frame member 12 (e.g., having a second engagement member 30, which is optional). In some such embodiments, for instance, when the frame is altered from a first configuration to a second configuration, the first frame member 10 moves relative to the second frame member 12. For example, in particular embodiments shown in the FIGs, when the frame assembly 2 is altered from a first configuration 4 shown in FIG. 1 (expanded or uncollapsed) to a second configuration 3 shown in FIG. 4 (collapsed), the first frame member 10 moves relative to the second frame member 12 until the first engagement member 30 engages the second engagement member 30 or until the first engagement member 30 engages the longitudinal arm 18 of the second frame member 12. Further, in some embodiments of an apparatus that includes the frame assembly 2, where the frame assembly 2 includes a first frame member 10 and a second frame member 12, when the frame is altered from a first configuration 4 to a second configuration 3, the second frame member 12 slides against the first frame member 10. In some (e.g., such) embodiments, the first frame member 10 has a first engagement member 30 and when the frame is altered from the first configuration 4 to the second configuration 3, the second frame member 12 moves relative to the first frame member 10 until the first engagement member 30 engages the second frame member 12. Still further, in particular embodiments, the second frame member 12 has a second engagement member 30 and when the frame assembly 2 is altered from the first configuration 4 to the second configuration 3, the second frame member 12 moves relative to the first frame member 10 until the first engagement member 30 engages the second engagement feature.

In various embodiments, the apparatus 1 includes a first fastener 100 (e.g., a buckle) and when the frame is in the first configuration 4 or in the second configuration 3, as examples, the first fastener can be fastened to hold the (e.g., alterable) frame assembly 2 (e.g., in the first or second configurations 4, 3). Further, certain embodiments (e.g., of an apparatus for carrying items) include a fabric body 102, a first fastener 100 (e.g., connected to the fabric body), and a (e.g., collapsible) frame assembly 2 (e.g., within the fabric body). Still further, in some embodiments, the (e.g., collapsible) frame assembly 2 includes a first frame member 10 and a second frame member 12. Even further, in some embodiments, when the (e.g., collapsible) frame is in the first configuration 4 (e.g., to an uncollapsed configuration), the first fastener 100 can be fastened to hold the (e.g., collapsible) frame assembly 2 (e.g., in the first configuration 4). Some such embodiments include two or more fasteners 100, for example, on opposite sides.

In some embodiments (e.g., having the first frame member 10 and the second frame member 12), the apparatus 1 (e.g., further) includes a third frame member 16, for example, having a first end comprising a transverse 24 and a second end comprising a transverse base 26 (e.g., opposite the first end). Further, in some embodiments, for example, when the frame assembly 2 is expanded from the second configuration 3 to the first configuration 4, or when the frame assembly 2 is altered (e.g., from the first configuration 4 to the second configuration 3), the first frame member 10 rotates (or pivots) relative to the third frame member 16. In other words, the longitudinal arms 18 of the first frame member 10 rotate about an axis parallel to the transverse base 26. Similarly, when the frame assembly 2 is expanded from the second configuration 3 to the first configuration 4, the second frame member 12 rotates (or pivots) relative to the third frame member 16. In other words, the longitudinal arms 18 of the second frame member 12 rotate about an axis parallel to the transverse base 24.

Some embodiments (e.g., of an apparatus for carrying items), include a (e.g., collapsible) frame assembly 2 that includes a first frame member 10 and a third frame member 16. The third frame member has a first end comprising the transverse base 24 and a second end comprising the transverse base 26 (e.g., the second end being opposite the first end). Moreover, in a number of embodiments, for example, when the collapsible frame is expanded from the second configuration 3 to the first configuration 4, the first frame member 10 rotates around the third frame member 16 as explained above. In some such embodiments, the apparatus 1 or the (e.g., collapsible) frame assembly 2 further includes the second frame member 12 (e.g., described herein). The second frame member 12, similarly, rotates relative to the third frame member 16 as explained above.

Even further still, in some embodiments, an apparatus 1 includes an alterable frame assembly 2 that includes a first frame member 10 and a third frame member 16 (e.g., having transverse bases 24 and 26 connected by longitudinal arms 22), and when the frame assembly 1 is altered (e.g., from a first configuration 4 to a second configuration 3), the first frame member 10 rotates about an axis generally parallel to one of the transverse bases 24 and 26 of the third frame member 16. If a second frame member 12 is included, the second frame member 12 would rotate about an axis generally parallel to the other of the transverse bases 24 and 26 in a movement similar to those described above.

In a number of embodiments of the apparatus 1 that includes the third frame member 16, the first frame member is connected to the third frame member with fabric, such as the fabric body 102 of the apparatus 1 shown in FIGS. 1 and FIGS. 13-21. In various embodiments, the fabric allows the first frame member 10 to rotate relative to the third frame member 16 as described above. In some embodiments, the fabric body 102 limits rotation (and/or movement) of the first frame member 10 to a first angle, as measured by the acute angle formed between the longitudinal arms 18 of the first frame member 10 and the third frame member 16. Even further, in various embodiments, the first angle is less than 45 degrees, the first angle is less than 30 degrees, or the first angle is less than 20 degrees, as examples. Further still, in some embodiments, the first angle is more than 10 degrees or the first angle is more than 15 degrees, as examples. In some embodiments, the second frame member 16 is connected to the third frame member also within fabric body 102 and the fabric allows the second frame member to rotate as described above. The fabric body 102 limits rotation of the second frame member 12 similar to the first frame member 10 and may form a second angle between the longitudinal arms 18 of the second frame member 12 and the third frame member 16, with angles similar to the first angle above.

In various embodiments, the apparatus 1 has a top and a bottom. Further, in a number of embodiments, the first end comprising transverse member 26 of the third frame member 16 is at the top of the apparatus 1, and the second end comprising transverse member 24 of the third frame member 16 is at the bottom of the apparatus, which of course could be reversed. Still further, in some embodiments, the transverse member 24 may include one or more feet 5, such as a first foot 5 and a second foot 5, see FIG. 2. In some embodiments, the second frame 2 may have one or more feet 5 on the transverse base 20 as shown in FIG. 3 The one or more feet 5 may facilitate the stability of the apparatus 1 (e.g., in the uncollapsed configuration) when the apparatus 1 is placed on a surface on the first foot, the second foot, the third foot, and the fourth foot. FIG. 1 shows an example.

Certain embodiments are or include an apparatus for an adult to use to carry a child (e.g., a child carrier). In other embodiments, the apparatus 1 may be a backpack, a luggage, or dufflebag, or the like. In various embodiments, the apparatus includes a frame, for example, that includes multiple frame members. Further, in a number of embodiments, the frame is collapsible. Still further, in some embodiments, the apparatus does not include a pin joining any of the multiple frame members, the apparatus does not include a hinge joining any of the multiple frame members, or both (i.e., no hinge and no pin). In other words, frame assembly 2 includes frame member 10, frame member 12, and frame member 16, but the frame members are not specifically interconnected. Rather, the fabric body 102 is shaped to hold the frame members 10, 12, and 16 in position relatively to each other in the various configurations and movement between the same. Even further, in particular embodiments, the apparatus includes fabric joining the multiple frame members, the fabric allows the frame to collapse, or both. The fabric body 102 of the apparatus may include inner and outer panels that define a space therebetween. The frame members, such as frame members 10, 12, and 16 reside in the space defined by the various inner and outer panels. The movement of the frame members 10, 12, and 16 relative to each other as described herein is facilitate by the frame member moving within the space between the inner and outer panels, such as, along a seam or the like. Further still, in various embodiments, the apparatus includes a frame that includes multiple frame members, the frame is collapsible, the apparatus includes fabric joining the multiple frame members, and the fabric allows the frame to collapse. In certain embodiments, the fabric allows the frame to collapse when the first fastener, second fastener, or both (e.g., described herein) are unfastened (e.g., unbuckled).

Figure 17:
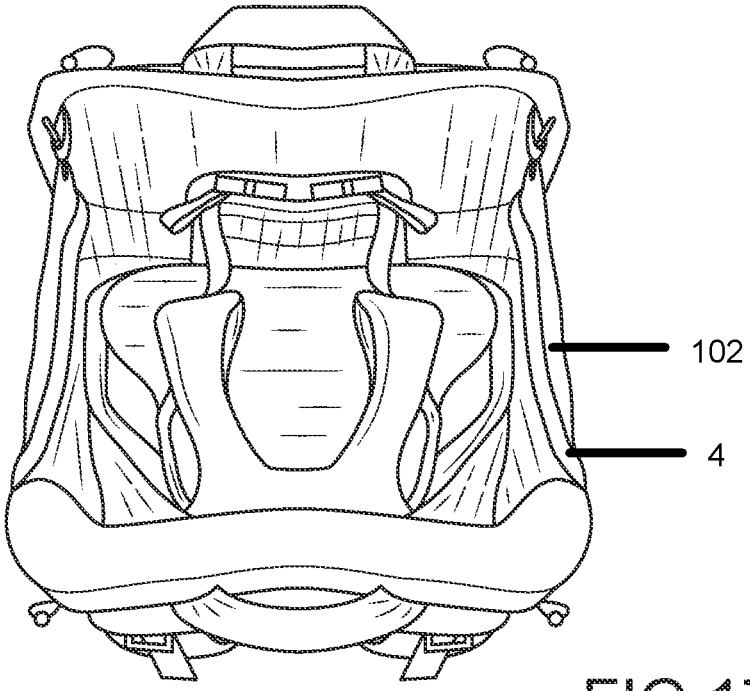
FIG. 17 is another view of the child carrier of FIG. 13.
Figure 18:
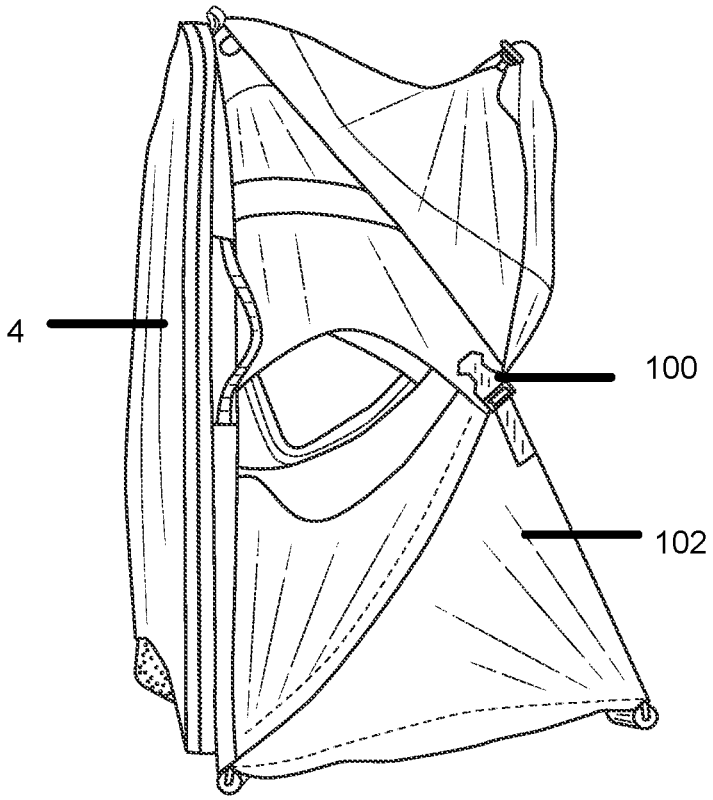
FIG. 18 is another view of the child carrier of FIG. 13.
Figure 19:
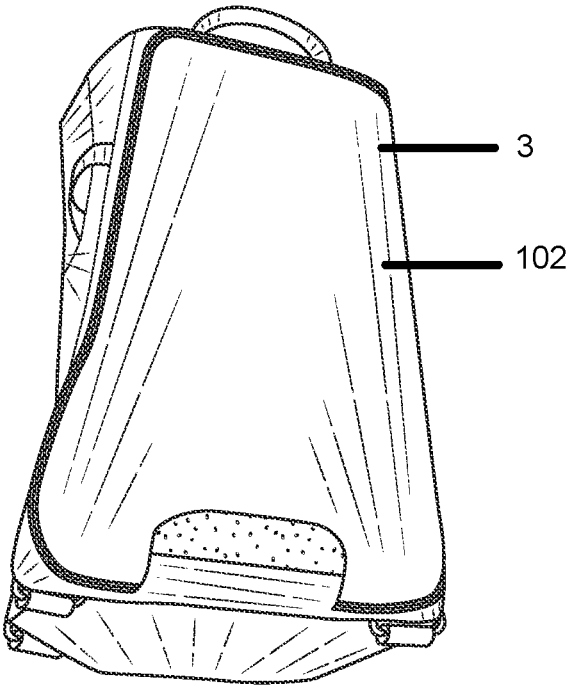
FIG. 19 is another view of the child carrier of FIG. 13.
Figure 20:
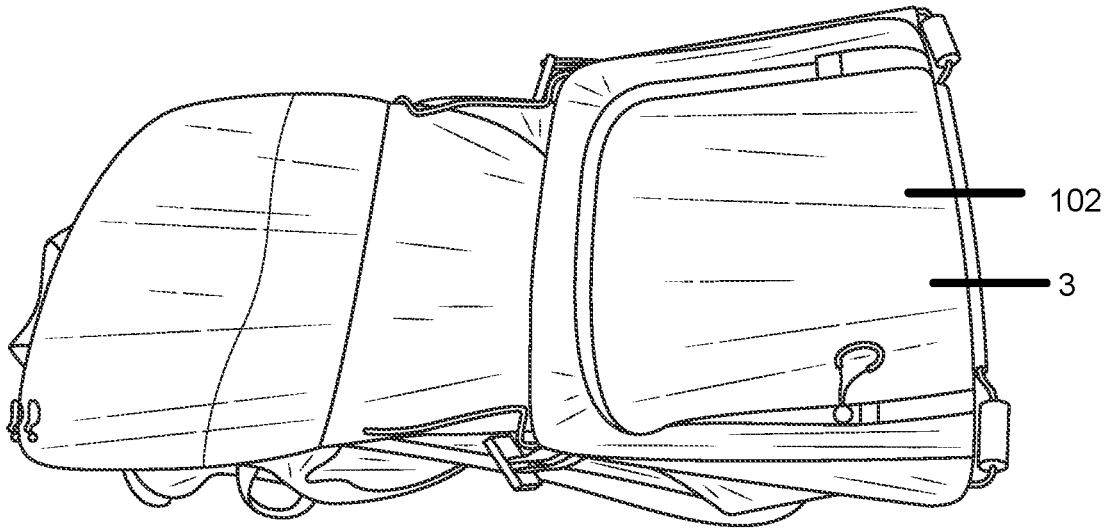
FIG. 20 is a view of the child carrier of FIG. 13 at least partially collapsed.
Figure 21:
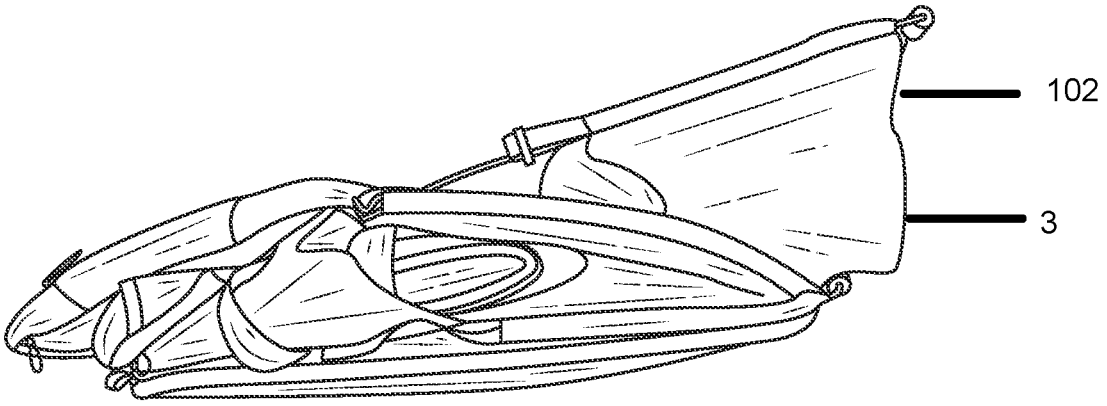
FIG. 21 is another view of the child carrier of FIG. 20.
Figure 22:
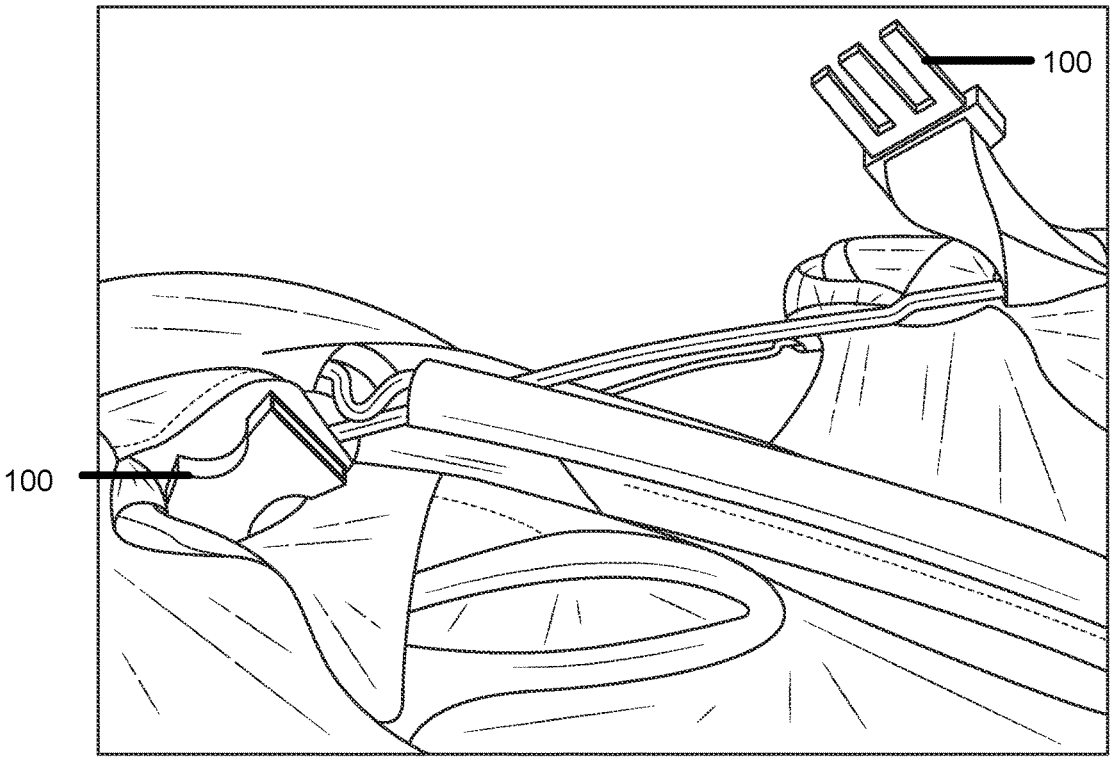
FIG. 22 is a detail of a portion of the frame of the child carrier of FIG. 20.
Figure 23:
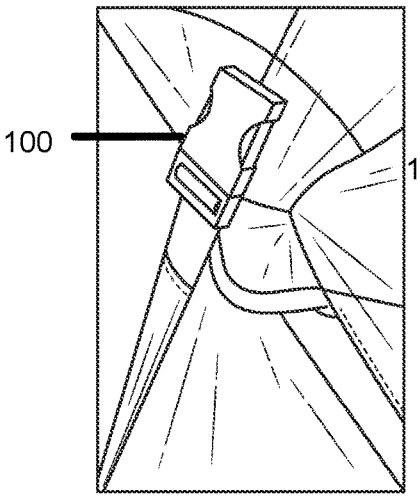
FIGS. 23 to 27 are details of portions of the child carrier of FIG. 20.
Figure 24:
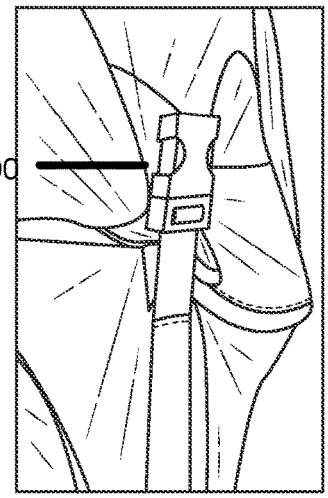
Figure 25:
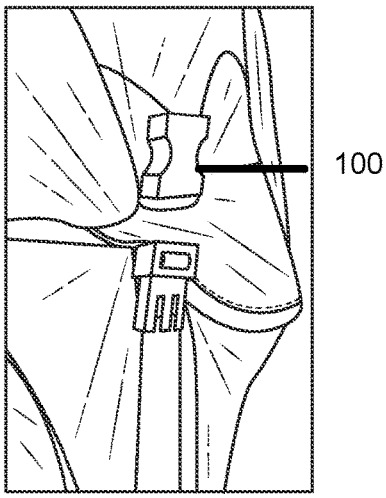
Figure 26:
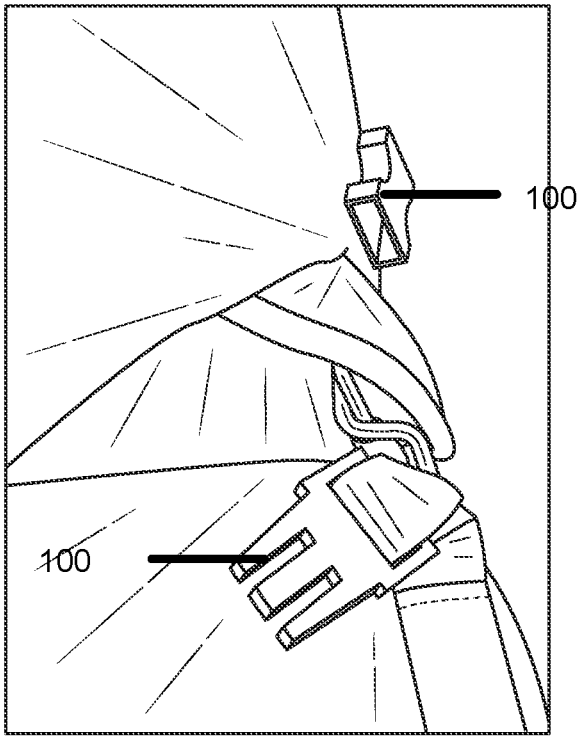
Figure 27:
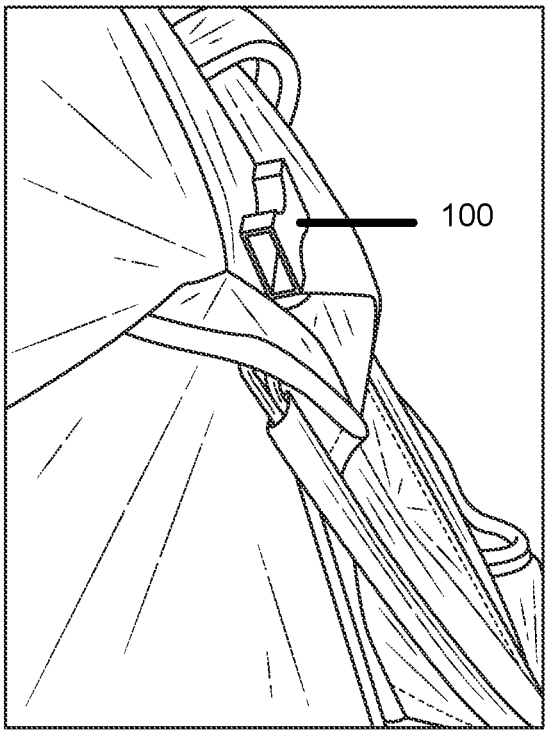

As mentioned, in various embodiments, the apparatus 1 (e.g., for an adult to use to carry a child) includes a frame assembly 2 that includes a first frame member 10, a second frame member 12, and a third frame member 16 (e.g., having a first end and a second end). The third frame member 16 provides vertical structure and the first frame member 10 and the second frame member 12 form a cradle or three-dimensional structure, for example, within which the child is suspended, or a combination thereof. Further, in some embodiments, the apparatus 1 further includes (e.g., within the 3-dimensional structure) a seat for the child (FIG. 16), a harness for the child (FIG. 14), or both (FIG. 17). Still further, in a number of embodiments, the third frame member 16 provides vertical structure for the apparatus 1, for the adult, or both. Even further, in some embodiments, the apparatus includes textile (e.g., fabric) sleeves, as are generally known in the art, but not specifically shown, for example, configured to allow the first frame member and the second frame member to collapse. In some embodiments, the fabric body 102 may have an inner and outer fabric layer that define a sleeve (or space) therebetween in which the frame members move. Even further still, in some embodiments, the textile (e.g., fabric) sleeves are configured to allow the first frame member 10 and the second frame member 12 to lock together at engagement members 30, for example, when the frame assembly 1 or the first frame member 10 and the second frame member 12 are opened (e.g., when expanded or uncollapsed). Further still, in various embodiments, the apparatus further includes (e.g., two) side release fasteners 100, such as buckles 100 shown in FIGS. 22-27, for example, that secure the first frame member and the second frame member (e.g., when the apparatus is opened). While fastener 100 is described as a buckle, having an associated male and female part, the fastener 100 may comprise other devices such as snaps (also having a male and female part), hook & loop piles, releasable adhesives, slide locks, or the like.

In some embodiments, the apparatus 1 (e.g., for carrying items) includes a frame assembly 2 that includes the first frame member 10, the second frame member 12, and the third frame member 16 (e.g., having transverse bases 24 and 26), and the first frame member 10 crosses the second frame member 12 at the engagement member 30, which may be a single engagement member 30 in the first frame member 10 or a pair of engagement members 30 with one in the first frame member 10 and another in the second frame member 12. To facilitate the locking arrangement, the frame members 10 and 12 may be biased such that longitudinal arms 18 move towards each other. In various such embodiments, for example, the transverse base 26 is opposite the transverse base 24, the first frame member 10 extends from the transverse base 24 of the third frame member 16, the second frame member 12 extends from the transverse base 26 of the third frame member 16. Moreover, in various embodiments that include the first frame member 10, the first frame member 10 includes a first section of the first frame member, a second section of the first frame member, and a third section of the first frame member. Furthermore, in some embodiments, the first section of the first frame member is separated from the second section of the first frame member by a first bend or elbow in the first frame member, which corresponds to the engagement member 30, the second section of the first frame member is separated from the third section of the first frame member by a second bend or elbow in the first frame member, which corresponds to the engagement member 30, or both. Even further, in various embodiments, the first bend in the first frame member is a substantially right angle, the second bend in the first frame member is a substantially right angle, or both. As used herein, unless indicated otherwise, "substantially" means within plus or minus ten percent. So "a substantially right angle" is an angle between 81 and 99 degrees. Further, where the word "substantially" is used herein, other embodiments are contemplated where the indicated value is within 1, 2, 3, 4, 5, 6, 8, 12, 15, 20, 25, 30, 40, or 50 percent, as other examples.

In particular embodiments, the first section of the first frame member 10 is substantially parallel to the third section of the first frame member 10. As used herein, "substantially parallel" means parallel to within ten percent of the length of the section over at least 90 percent of the length of the section, except that less than half of the length of the section may be substantially opposite hand. Further, in some embodiments, the first section of the first frame member is substantially opposite hand to the third section of the first frame member. As used herein, "substantially opposite hand" means opposite hand to within ten degrees of angle and to within ten percent of an overall length of the section. Still further, in certain embodiments, the first section of the first frame member has a first radius of curvature of the first frame member in a substantially common direction extending over at least 25 percent of a length of the first section of the first frame member. As used herein, a "substantially common direction" means, when referring to a radius of curvature, that a portion of the section having the radius of curvature is all within a common plane to within ten percent of an arc length of the portion of the section having the radius of curvature. In other embodiments, the first radius of curvature of the first frame member in the substantially common direction extends over at least 20, 30, 35, 40, 50, 60, or 75 percent of the length of the first section of the first frame member, as other examples. Even further, in some embodiments, the first radius of curvature of the first frame member is concave toward (e.g., the second end of) the third frame member, toward a (e.g., cut) end of the first frame member, or both, as examples.

In various embodiments, the first frame member includes a first engagement member 30 between the first section and the second section of the first frame member 10. Further, in a number of embodiments, the first frame member includes a first engagement member 30 between the third section and the second section of the first frame member 10. Various embodiments include both such first engagement members 30, for example, on opposite (e.g., right and left) sides of the apparatus. Further still, in a number of embodiments that include the first and/or second engagement member 30, the (e.g., each) engagement members 30 include a first bend or elbow in the first frame member, wherein the bend in the first frame member 10 forming the engagement member 30 is at least 90 degrees. and no more than 120 degrees. In certain embodiments, the angle is at least 45 degrees and no more than 135 degrees.

In a number of embodiments of an apparatus 1, the second section of the first frame member 10 is opposite the first end of the third frame member 16. Further, in various embodiments, the second section of the first frame member 10 is diagonally opposite the first end of the third frame member 16. Still further, in some embodiments, the first section of the first frame member 10 has a cut end, for example, opposite the second section of the first frame member 10. Further still, in some embodiments, the third section of the first frame member 10 has a cut end opposite the second section of the first frame member 10. Even further, some embodiments include both such cut ends. Further still, in a number of embodiments, the first frame member 10, second frame member 12, third frame member 16, or a combination thereof, is (or are) monolithic, includes metal, includes steel, includes stainless steel, has a solid cross section, has a substantially round cross section (i.e., round to within ten percent variation in diameter), or a combination thereof, as examples. In other embodiments a frame assembly 2 with the first frame member 10, the second frame member 12, and the third frame member 16 may be made of, or may include, titanium or aluminum, as further examples. Even further still, in some embodiments, the first frame member 10, second frame member 12, third frame member 16, or a combination thereof, consists essentially of metal, steel, or stainless steel, has a round cross section, or a combination thereof, as further examples. In yet further embodiments, the frame assembly 2 with the first frame member 10, the second frame member 12, and the third frame member 16 may be formed from composites, fiberglass, carbon fiber, metals, metal alloys, combinations thereof, or the like.

In various embodiments of an apparatus 1 that includes the frame assembly 2 may include the second frame member 12. The second frame member 12 may be consistent with the description of the first frame member 10, above, and will not be redescribed here.

In various embodiments of an apparatus 1 that includes the third frame member 16, the third frame member 16 may include a mesh panel (e.g., back panel not specifically shown but generally known in, for example, the backpack arts). The mesh panel may extend over all or a portion of the area defined by the third frame member 16. In various embodiments, the apparatus includes a three-dimensional back panel or a suspended trampoline back panel, as examples. The third frame member 16 is shown in the figures as having a rectangular shape, but the third frame member 16 may have other shapes, such as, for example, a square, I beam or H beam shape (e.g., a single longitudinal arm with opposed transverse bases 24 and 26).

In addition, in various embodiments, the third frame member further includes a fourth section of the third frame member. For example, in a number of embodiments, the fourth section of the third frame member is separated from the third section of the third frame member by a third bend in the third frame member. Further, in certain embodiments, the third bend in the third frame member is a substantially right angle. Still further, in some embodiments, the fourth section of the third frame member is separated from the first section of the third frame member by a fourth bend in the third frame member. Even further, in particular embodiments, the fourth bend in the third frame member is a substantially right angle. Further still, in various embodiments, the third frame member includes two cut ends of the third frame member. Even further still, in a number of embodiments, the two cut ends of the third frame member are substantially adjacent. As used herein, "substantially adjacent", when referring to features on a frame member, means space between the features is less than ten percent of an overall length of the frame member. Moreover, in certain embodiments, the two cut ends of the third frame member are adjacent. As used herein, "adjacent", when referring to features on a frame member, means space between the features is less than five percent of an overall length of the frame member. Wherever "substantially adjacent" is used herein, embodiments are also contemplated where the two features (e.g., bends) are "adjacent". Furthermore, in some embodiments, the third frame member includes a joint, for example, that connects the two cut ends of the third frame member. Additionally, in particular embodiments, the third frame member includes a connector, for instance, that connects the two cut ends of the third frame member. Further, in some embodiments, the fourth section of the third frame member is substantially parallel to the second section of the third frame member. In a number of embodiments, however, the second section of the third frame member is curved. In some embodiments, the fourth section of the third frame member is curved, but in a number of embodiments, the second section of the third frame member is curved at a shorter radius of curvature than the fourth section of the third frame member. In particular embodiments, however, the fourth section of the third frame member is substantially straight. Still further, in a number of embodiments, the second section of the third frame member is at the second end of the third frame member. Even further, in various embodiments, the fourth section of the third frame member is at the first end of the third frame member.

In a number of embodiments, the first frame member 10 has a U (or inverted U) shape. For example, in various embodiments, when the apparatus 1 is upright, the first frame member has a U shape (e.g., when viewed from the front or from the back of the apparatus when the apparatus is upright). Further, in a number of embodiments, the first frame member 10 has rounded corners. Examples include the first bend in the first frame member 10 and the second bend in the first frame member 10 described herein. Still further, in some embodiments, the second frame member 12 has a U (or inverted U) shape. Even further, in particular embodiments, when the apparatus 1 is upright, the second frame member has an inverted U shape (note the first frame member 10 may have an inverted U shape in which case the second frame member 12 would have a U shape). Further still, in a number of embodiments, the second frame 12 member has rounded corners. Examples include the first bend in the second frame member 12 and the second bend in the second frame member 12 described herein. Even further still, in a number of embodiments, the third frame 16 member has a rectangular shape. For instance, in some embodiments, when the apparatus is upright, the third frame member 16 has a rectangular shape. Furthermore, in some embodiments, the third frame member 16 has rounded corners.

In various embodiments, the frame assembly 2 bends (e.g., plastically deforms) rather than breaking when an excessive force is applied to the frame frame assembly 2. The fabric body 102 may constrain the direction and amount of bending of the frame assembly 2. For example, in a number of embodiments, when the apparatus is in an upright position on a flat surface and an excessive force is applied to a top of the apparatus 1, the frame assembly 2 bends rather than breaking. Further, in various embodiments, the frame assembly 2 bends rather than buckling when an excessive force is applied to the frame assembly 2. Buckling meaning the frame assembly 2 collapses in a non-controlled manner. For example, in a number of embodiments, when the apparatus 1 is in an upright position on a flat surface and an excessive force is applied to a top of the apparatus 1, the frame assembly 2 bends rather than buckling.

In some embodiments, the apparatus is a piece of luggage, for instance, for carrying items while traveling. Examples of traveling include, for instance, business travel, adventure travel, RV travel, and travel with luggage, for instance, on roof racks, among other things. Further, in some embodiments, the apparatus is a bag, for example, for carrying items. Further still, in particular embodiments, the apparatus is a duffle bag, for instance, for carrying items. For example, in certain embodiments, the apparatus is a travel duffle. Still further, in a number of embodiments, the apparatus is a backpack, for example, for carrying items on the back of a user. For example, in particular embodiments, the apparatus is a daypack, for instance, for carrying items on the back of a user. Even further, in various embodiments, the apparatus is a child carrier, for example, for carrying a child on the back of a user. The child, for example, may be a baby or a toddler, as examples. In certain embodiments, the apparatus is a baby carrier. Further still, in certain embodiments, the apparatus is, includes, or is configured to be used as a stroller, a bike trailer, or both, as examples.

In a number of embodiments, the apparatus includes a child harness for securing a child within the apparatus, the apparatus includes a child seat for carrying a child within the apparatus, or both, as examples. A child carrier is an example. Even further still, in various embodiments, the apparatus includes a carrying harness, for instance, for attaching the apparatus to the back of a user. Moreover, in some embodiments, the apparatus includes a cover, for example, configured to cover the carrying harness, for instance, while the apparatus is being shipped. Furthermore, in particular embodiments, the apparatus includes a zipper, for example, that secures the cover over the carrying harness, for instance, while the apparatus is being shipped. In certain embodiments, the cover can protect the carrying harness from getting caught (e.g., in a baggage conveyor or carousel) or from getting dirty or damaged. Further, in a number of embodiments, the third frame member is substantially adjacent to, or even adjacent to, the carrying harness. Still further, in particular embodiments, the carrying harness is attached to the third frame member. In certain embodiments, the carrying harness is attached to the fabric body (e.g., described herein) of the apparatus, for example, near third frame member. As used herein, "near" means within ten percent of a largest overall dimension of the apparatus. In particular embodiments, for example, the harness may be attached with a strap, for example, comprising an adjustment mechanism. In a number of embodiments, the apparatus, or the carrying harness, includes a first shoulder strap, a second shoulder strap, a hip belt, or a combination thereof. Still further, in some embodiments, the apparatus includes two lifting straps. For instance, in some embodiments, the two lifting straps are on opposite sides of the apparatus. Even further, in particular embodiments, the apparatus includes four lifting straps. For example, in certain embodiments, the apparatus has four sides (e.g., when standing upright) and each side has a lifting strap. In a number of embodiments, the apparatus is configured to stand up, for example, when uncollapsed or when opened. The embodiment shown in FIG. 1, for example, is standing upright in an uncollapsed or open configuration and is configured to stand up in this configuration.

As mentioned, in a number of embodiments, the apparatus includes a fabric body 102. Further, in various embodiments, the apparatus further includes sleeves, for example, in the fabric body, for instance, that contain the frame assembly 2. In certain embodiments, for example, the apparatus includes sewn sleeves in the fabric body 102 that contain the frame assembly 2. Still further, in a number of embodiments, the fabric body 102 increases the load bearing capacity of the apparatus 1 including the frame assembly 2, for example, by supporting the frame assembly 2 and potentially constraining the movement, bending, and flexing of the longitudinal arms and transverse members. For instance, in particular embodiments, the fabric body 102 increases compressive strength of apparatus 1 comprising the frame assembly 2 by supporting the frame assembly 2 against buckling. An example is strength to withstand a vertical load applied downward to the top of the apparatus 1 when the apparatus 1 is sitting on a flat level surface. Another example is strength to withstand being placed down hard on the bottom of the apparatus 1, for example, on a flat level surface, for instance, when the apparatus 1 is (e.g., fully) loaded, such as with a child in the child carrier. In some embodiments, for example, the frame assembly 2 (e.g., at least one frame member 10, 12, or 16) is curved to control direction of the buckling to facilitate increasing the compressive strength of the apparatus 1 by the fabric body 102. In particular embodiments, for instance, the frame assembly 2 or frame member 10, 12, and/or 16 is curved in a substantially common plane with a wall (e.g., side wall) of the fabric body 102, for example. In such a configuration, when the frame assembly 2 or frame member 10, 12, and/or 16 is loaded in compression, the curvature increases and the fabric body 102 resists the increase in curvature by supporting the frame member 10, 12, and 16 along its length. In various embodiments, the frame is within the fabric body 102 or a space defined by panels of the fabric body 102. Even further, in some embodiments, the apparatus includes graphene. Graphene may increase strength, wear resistance, or both, as examples. For instance, in particular embodiments that include fabric (e.g., the fabric body 102), the fabric includes graphene. Further, in certain embodiments that include a strap, the strap includes graphene. Further, certain embodiments include UHMWPE, Spectra, or both, for example, in fabric, straps, or both.

As also mentioned, in some embodiments, the apparatus includes a one or more fastener 100, for example, connected to the fabric body 102. Further, in a number of embodiments, the fastener 100 can be fastened (e.g., by the user) to hold the frame assembly in an (e.g., uncollapsed) configuration, first configuration 4. For instance, in some embodiments, when the frame assembly 2 is expanded (e.g., by the user) to an uncollapsed configuration or first configuration 4, the fastener 100 can be fastened (e.g., by the user) to hold the frame assembly 2 within the fabric body 102 in the uncollapsed configuration. The fastener 100 may be unfastened (e.g., by the user) before the frame assembly 2 is collapsed to the second configuration 3 (e.g., by the user, for instance, to a collapsed configuration). The apparatus 1 may include one or more fasteners 100.

Various embodiments meet certain safety requirements or have certain safety features. In a number of embodiments, for example, the apparatus 1 is certified to conform with ASTM F2549-14aV, EN 13209-12004, or both. Further, in various embodiments, a contact point between two frame members, such as the engagement member 30 (or engagement members 30) of first frame member 10 and second frame member 12, is covered (e.g., with fabric), for example, to protect a child's fingers from getting pinched, hurt, or caught between the two frame members. Even further, in various embodiments, the cover (e.g., fabric) to protect the child's fingers is cone shaped, shaped like a truncated cone, similar to engagement lock member 32, includes a frustum, or a combination thereof. Further still, in some embodiments, the apparatus includes a flap to protect a child's fingers from getting pinched between frame members. Even further still, in various embodiments, the apparatus includes a cover to protect a child's fingers from getting pinched between frame members. In some embodiments, the cover is fabric, but in other embodiments, the cover may be made of, or include, a different material, for example, plastic or polymer. In a number of embodiments, for instance, the cover to protect a child's fingers from getting pinched (e.g., between frame members) is molded.

Some embodiments include wheels or casters, which are not shown but generally known in the art. For example, in a number of embodiments, the apparatus includes two wheels, or at least two wheels, for instance, for rolling the apparatus on a flat surface. For example, in particular embodiments, the apparatus includes two wheels for rolling the apparatus on a flat surface and the two wheels are attached to the third frame member 16, or attached to the apparatus near the third frame member 16, as examples. For instance, in particular embodiments, the two wheels are located near the transverse base 24 of the third frame member 16. Further, in certain embodiments, the two wheels are attached to the transverse base 24 at the second end of the third frame member 16. In other embodiments, the two wheels are attached to the first frame member 10 proximal the transverse base 24, or towards the terminal ends of the longitudinal arms 18. Alternatively, the two wheels are attached to the second frame member 12 proximal the transverse base 26, or towards the terminal ends of the longitudinal arms 18.

Other embodiments include an apparatus or method of obtaining or providing an apparatus or information, for instance, that include a novel combination of the features described herein. Even further embodiments include at least one means for accomplishing at least one functional aspect described herein. The subject matter described herein includes various means for accomplishing the various functions or acts described herein or that are apparent from the structure and acts described. Each function described herein is also contemplated as a means for accomplishing that function, or where appropriate, as a step for accomplishing that function. Moreover, various embodiments include certain (e.g., combinations of) aspects described herein. All novel combinations are potential embodiments. Some embodiments may include a subset of elements described herein and various embodiments include additional elements as well. Various methods include various combinations of acts described herein. All feasible combinations are contemplated.

Further, various embodiments of the subject matter described herein include various combinations of the acts, structure, components, and features described herein, shown in the drawings, described in any documents that are incorporated by reference herein, or that are known in the art. Moreover, certain procedures can include acts such as manufacturing, obtaining, or providing components that perform functions described herein or in the documents that are incorporated by reference. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

Examples of the Apparatus, Frame Assembly, and Frame Members

The examples include:

1. An apparatus for carrying items, the apparatus comprising: a collapsible frame comprising:

a first frame member having a first engagement feature; and a second frame member having a second engagement feature;

wherein, when the collapsible frame is expanded from a collapsed configuration to an uncollapsed configuration, the first frame member moves relative to the second frame member until the first engagement feature engages the second engagement feature.

2. An apparatus for carrying items, the apparatus comprising: a collapsible frame comprising:

a first frame member; and a second frame member;

wherein, when the collapsible frame is expanded from a collapsed configuration to an uncollapsed configuration, the second frame member slides against the first frame member.

3. The apparatus of claim 2 wherein:

the first frame member has a first engagement feature; and when the collapsible frame is expanded from the collapsed configuration to the uncollapsed configuration, the second frame member moves relative to the first frame member until the first engagement feature engages the second frame member.

4. The apparatus of claim 3 wherein:

the second frame member has a second engagement feature; and when the collapsible frame is expanded from the collapsed configuration to the uncollapsed configuration, the second frame member moves relative to the first frame member until the first engagement feature engages the second engagement feature.

5. An apparatus comprising: an alterable frame, the frame comprising:

a first frame member having a first engagement feature; and a second frame member having a second engagement feature;

wherein, when the frame is altered from a first configuration to a second configuration, the first frame member moves relative to the second frame member until the first engagement feature engages the second engagement feature.

6. An apparatus comprising: an alterable frame, the frame comprising:

a first frame member; and a second frame member;

wherein, when the frame is altered from a first configuration to a second configuration, the second frame member slides against the first frame member.

7. The apparatus of claim 6 wherein:

the first frame member has a first engagement feature; and when the frame is altered from the first configuration to the second configuration, the second frame member moves relative to the first frame member until the first engagement feature engages the second frame member.

8. The apparatus of claim 7 wherein:

the second frame member has a second engagement feature; and when the frame is altered from the first configuration to the second configuration, the second frame member moves relative to the first frame member until the first engagement feature engages the second engagement feature.

9. The apparatus of any of the claims herein wherein:

the apparatus further comprises a first fastener; and when the frame is uncollapsed, open, or in the second configuration, the first fastener can be fastened to hold the frame in the uncollapsed, open, or second configuration.

10. An apparatus for carrying items, the apparatus comprising:

a fabric body;

a first fastener connected to the fabric body; and a collapsible frame within the fabric body, the collapsible frame comprising:

a first frame member; and a second frame member;

wherein, when the collapsible frame is expanded to an uncollapsed configuration, the first fastener can be fastened to hold the collapsible frame in the uncollapsed configuration.

11. The apparatus of any of the claims herein having the first frame member and the second frame member, the apparatus further comprising: a third frame member having a first end and a second end, wherein: the second end is opposite the first end.

12. The apparatus of the previous claim wherein, when the frame is expanded from the collapsed configuration to the uncollapsed configuration, or when the frame is altered from the first configuration to the second configuration, the first frame member rotates relative to the third frame member.

13. The apparatus of the previous claim wherein, when the frame is expanded from the collapsed configuration to the uncollapsed configuration, or when the frame is altered from the first configuration to the second configuration, the first frame member rotates around the first end of the third frame member.

14. The apparatus of any of the claims herein that include the third frame member wherein, when the frame is expanded from the collapsed configuration to the uncollapsed configuration, or when the frame is altered from the first configuration to the second configuration, the second frame member rotates relative to the third frame member.

15. The apparatus of any of the claims herein that include the third frame member wherein, when the frame is expanded from the collapsed configuration to the uncollapsed configuration, or when the frame is altered from the first configuration to the second configuration, the second frame member rotates around the second end of the third frame member.

16. An apparatus for carrying items, the apparatus comprising: a collapsible frame comprising:

a first frame member; and a third frame member having a first end and a second end, wherein: the second end is opposite the first end;

wherein, when the collapsible frame is expanded from a collapsed configuration to an uncollapsed configuration, the first frame member rotates around the first end of the third frame member.

17. The apparatus of the previous claim wherein: the collapsible frame further comprises a second frame member.

18. The apparatus of the previous claim wherein, when the frame is expanded from the collapsed configuration to the uncollapsed configuration, the second frame member rotates relative to the third frame member.

19. The apparatus of the previous claim wherein, when the frame is expanded from the collapsed configuration to the uncollapsed configuration, the second frame member rotates around the second end of the third frame member.

20. The apparatus of any of the claims herein that include a first frame member and a second frame member, wherein, when the frame is expanded from the collapsed configuration to the uncollapsed configuration, the second frame member rotates relative to the first frame member.

21. The apparatus of any of the claims herein that include a first frame member and a second frame member, wherein, when the frame is expanded from the collapsed configuration to the uncollapsed configuration, the second frame member slides against the first frame member.

22. An apparatus comprising: an alterable frame, the frame comprising:
a first frame member; and
a third frame member having a first end and a second end, wherein: the second end is opposite the first end;
wherein, when the frame is altered from a first configuration to a second configuration, the first frame member rotates around the first end of the third frame member.

23. The apparatus of the previous claim wherein: the frame further comprises a second frame member.

24. The apparatus of the previous claim wherein, when the frame is altered from the first configuration to the second configuration, the second frame member rotates relative to the third frame member.

25. The apparatus of the previous claim wherein, when the frame is altered from the first configuration to the second configuration, the second frame member rotates around the second end of the third frame member.

26. The apparatus of any of the claims herein that include a first frame member and a second frame member, wherein, when the frame is altered from the first configuration to the second configuration, the second frame member rotates relative to the first frame member.

27. The apparatus of any of the claims herein that include a first frame member and a second frame member, wherein, when the frame is expanded from the first configuration to the second configuration, the second frame member slides against the first frame member.

28. The apparatus of any of the claims herein that include the third frame member wherein:
the first frame member is connected to the third frame member with fabric; and
the fabric allows the first frame member to rotate around the first end of the third frame member over a first angle of rotation.

29. The apparatus of the previous claim wherein: the fabric limits rotation of the first frame member around the first end of the third frame member to the first angle.

30. The apparatus of any of the claims herein that include the first angle wherein: the first angle is less than 45 degrees.

31. The apparatus of any of the claims herein that include the first angle wherein: the first angle is less than 30 degrees.

32. The apparatus of any of the claims herein that include the first angle wherein: the first angle is less than 20 degrees.

33. The apparatus of any of the claims herein that include the first angle wherein: the first angle is more than 10 degrees.

34. The apparatus of any of the claims herein that include the first angle wherein: the first angle is more than 15 degrees.

35. The apparatus of any of the claims herein that include the third frame member and the second frame member, wherein:
the second frame member is connected to the third frame member with fabric; and
the fabric allows the second frame member to rotate around the second end of the third frame member over a second angle of rotation.

36. The apparatus of the previous claim wherein: the fabric limits rotation of the second frame member around the second end of the third frame member to the second angle.

37. The apparatus of any of the claims herein that include the second angle wherein: the second angle is less than 45 degrees.

38. The apparatus of any of the claims herein that include the second angle wherein: the second angle is less than 35 degrees.

39. The apparatus of any of the claims herein that include the second angle wherein: the second angle is less than 30 degrees.

40. The apparatus of any of the claims herein that include the second angle wherein: the second angle is more than 10 degrees.

41. The apparatus of any of the claims herein that include the second angle wherein: the second angle is more than 20 degrees.

42. The apparatus of any of the claims herein that include the third frame member wherein:
the apparatus has a top;
the apparatus has a bottom;
the first end of the third frame member is at the top of the apparatus; and
the second end of the third frame member is at the bottom of the apparatus.

43. The apparatus of any of the claims herein that include the first frame member and the second end of the third frame member wherein:
the second end of the third frame member comprises a first foot and a second foot;
the first frame member comprises a third foot and a fourth foot; and
the apparatus is stable in the uncollapsed configuration or in the second configuration when the apparatus is placed on a flat surface on the first foot, the second foot, the third foot, and the fourth foot.

44. An apparatus for an adult to use to carry a child, the apparatus comprising: a frame comprising: multiple frame members wherein:
the frame is collapsible; and
the apparatus does not include a pin joining any of the multiple frame members.

45. An apparatus for an adult to use to carry a child, the apparatus comprising: a frame comprising: multiple frame members wherein:
the frame is collapsible; and
the apparatus does not include a hinge joining any of the multiple frame members.

46. The apparatus of any of the claims herein that include the frame and the multiple frame members wherein:
the apparatus includes fabric joining the multiple frame members; and
the fabric allows the frame to collapse.

47. An apparatus for an adult to use to carry a child, the apparatus comprising: a frame comprising: multiple frame members wherein:
the frame is collapsible;
the apparatus includes fabric joining the multiple frame members; and
the fabric allows the frame to collapse.

48. An apparatus for an adult to use to carry a child, the apparatus comprising: a frame comprising:
a first frame member;
a second frame member; and
a third frame member having a first end and a second end; wherein:
the second end is opposite the first end;
the third frame member provides vertical structure; and the first frame member and the second frame member form a 3-dimensional structure within which the child is suspended.

49. The apparatus of the previous claim further comprising: within the 3-dimensional structure: a seat for the child; and a harness for the child.

50. The apparatus of either of the previous two claims wherein: the third frame member provides vertical structure for: the apparatus; and the adult.

51. The apparatus of any of the previous three claims further comprising: textile sleeves configured to allow the first frame member and the second frame member:
to collapse; and
to lock together when opened.

52. The apparatus of any of the claims herein that include the first frame member and the second frame member, the apparatus further comprising: two side release buckles that secure the first frame member and the second frame member when the apparatus is opened.

53. An apparatus for carrying items, the apparatus comprising: a frame comprising:
a first frame member;
a second frame member; and
a third frame member having a first end and a second end; wherein:
the second end is opposite the first end;
the first frame member extends from the first end of the third frame member;
the second frame member extends from the second end of the third frame member; and
the first frame member crosses the second frame member.

54. The apparatus of any of the claims herein that include the first frame member, wherein: the first frame member comprises:
a first section of the first frame member;
a second section of the first frame member; and
a third section of the first frame member.

55. The apparatus of the previous claim wherein:
the first section of the first frame member is separated from the second section of the first frame member by a first bend in the first frame member; and
the second section of the first frame member is separated from the third section of the first frame member by a second bend in the first frame member.

56. The apparatus of the previous claim wherein: the first bend in the first frame member is a substantially right angle.

57. The apparatus of the previous claim wherein: the second bend in the first frame member is a substantially right angle.

58. The apparatus of any of the claims herein that include the first frame member, wherein: the first frame member is monolithic.

59. The apparatus of any of the claims herein that include the first frame member, wherein: the first frame member comprises metal.

60. The apparatus of any of the claims herein that include the first frame member, wherein: the first frame member comprises steel.

61. The apparatus of any of the claims herein that include the first frame member, wherein: the first frame member comprises stainless steel.

62. The apparatus of any of the claims herein that include the first frame member, wherein: the first frame member has a solid cross section.

63. The apparatus of any of the claims herein that include the first frame member, wherein: the first frame member has a substantially round cross section.

64. The apparatus of any of the claims herein that include a first section of the first frame member and that include a third section of the first frame member, wherein: the first section of the first frame member is substantially parallel to the third section of the first frame member.

65. The apparatus of any of the claims herein that include a first section of the first frame member and that include a third section of the first frame member, wherein: the first section of the first frame member is substantially opposite hand to the third section of the first frame member.

66. The apparatus of any of the claims herein that include a first section of the first frame member, the first section of the first frame member having a first radius of curvature of the first frame member in a substantially common direction extending over at least 25 percent of a length of the first section of the first frame member.

67. The apparatus of the previous claim wherein: the first radius of curvature of the first frame member is concave toward the second end of the third frame member.

68. The apparatus of the previous claim wherein: the first radius of curvature of the first frame member is concave toward an end of the first frame member.

69. The apparatus of the previous claim wherein: the first radius of curvature of the first frame member is concave toward a cut end of the first frame member.

70. The apparatus of any of the claims herein that include the first section of the first frame member, the first frame member comprising: a first engagement feature in the first section of the first frame member.

71. The apparatus of any of the claims herein that include the third section of the first frame member, the first frame member comprising: a first engagement feature in the third section of the first frame member.

72. The apparatus of any of the claims herein that include the first engagement feature in the first section of the first frame member and the first engagement feature in the third section of the first frame member wherein: the first engagement feature in the first section of the first frame member and the first engagement feature in the third section of the first frame member are substantially opposite hand.

73. The apparatus of any of the claims herein that include the first engagement feature wherein: the first engagement feature comprises a first engagement feature bend in the first frame member.

74. The apparatus of the previous claim wherein: the first engagement feature bend in the first frame member is at least 90 degrees.

75. The apparatus of either of the previous two claims wherein: the first engagement feature bend in the first frame member is no more than 120 degrees.

76. The apparatus of any of the previous three claims wherein: the first engagement feature comprises a second engagement feature bend in the first frame member.

77. The apparatus of the previous claim wherein: the second engagement feature bend in the first frame member is at least 90 degrees.

78. The apparatus of either of the previous two claims wherein: the second engagement feature bend in the first frame member is no more than 120 degrees.

79. The apparatus of any of the previous three claims wherein: the second engagement feature bend in the first frame member is in substantially a same plane as the first engagement feature bend in the first frame member.

80. The apparatus of the previous claim wherein: the second engagement feature bend in the first frame member bends in a substantially opposite direction from the first engagement feature bend in the first frame member.

81. The apparatus of any of the claims herein that include the second section of the first frame member and the first end of the third frame member wherein: the second section of the first frame member is opposite the first end of the third frame member.

82. The apparatus of any of the claims herein that include the second section of the first frame member and the first end of the third frame member wherein: the second section of the first frame member is diagonally opposite the first end of the third frame member.

83. The apparatus of any of the claims herein that include the first section of the first frame member and the second section of the first frame member wherein: the first section of the first frame member has a cut end opposite the second section of the first frame member.

84. The apparatus of any of the claims herein that include the third section of the first frame member and the second section of the first frame member wherein: the third section of the first frame member has a cut end opposite the second section of the first frame member.

85. The apparatus of any of the claims herein that include the second frame member wherein: the second frame member comprises:

a first section of the second frame member;

a second section of the second frame member; and a third section of the second frame member.

86. The apparatus of the previous claim wherein:

the first section of the second frame member is separated from the second section of the second frame member by a first bend in the second frame member; and the second section of the second frame member is separated from the third section of the second frame member by a second bend in the second frame member.

87. The apparatus of the previous claim wherein: the first bend in the second frame member is a substantially right angle.

88. The apparatus of the previous claim wherein: the second bend in the second frame member is a substantially right angle.

89. The apparatus of any of the claims herein that include the second frame member, wherein: the second frame member is monolithic.

90. The apparatus of any of the claims herein that include the second frame member, wherein: the second frame member comprises metal.

91. The apparatus of any of the claims herein that include the second frame member, wherein: the second frame member comprises steel.

92. The apparatus of any of the claims herein that include the second frame member, wherein: the second frame member comprises stainless steel.

93. The apparatus of any of the claims herein that include the second frame member, wherein: the second frame member has a solid cross section.

94. The apparatus of any of the claims herein that include the second frame member, wherein: the second frame member has a substantially round cross section.

95. The apparatus of any of the claims herein that include a first section of the second frame member and having a third section of the second frame member wherein: the first section of the second frame member is substantially parallel to the third section of the second frame member.

96. The apparatus of any of the claims herein that include a first section of the second frame member, the first section of the second frame member having a first radius of curvature of the second frame member in a substantially common direction extending over at least 25 percent of a length of the first section of the second frame member.

97. The apparatus of the previous claim wherein: the first radius of curvature of the second frame member is concave toward the first end of the third frame member.

98. The apparatus of the previous claim wherein: the first radius of curvature of the second frame member is concave toward an end of the first frame member.

99. The apparatus of the previous claim wherein: the first radius of curvature of the second frame member is concave toward a cut end of the first frame member.

100. The apparatus of any of the claims herein that include the first section of the second frame member, the second frame member comprising: a second engagement feature in the first section of the second frame member.

101. The apparatus of any of the claims herein that include the third section of the second frame member, the second frame member comprising: a second engagement feature in the third section of the second frame member.

102. The apparatus of any of the claims herein that include the second engagement feature in the first section of the second frame member and the second engagement feature in the third section of the second frame member wherein:

the second engagement feature in the first section of the second frame member extends away from the second section of the first frame member; and the second engagement feature in the third section of the second frame member extends away from the second section of the first frame member.

103. The apparatus of any of the claims herein that include the second engagement feature wherein: the second engagement feature comprises a first engagement feature bend in the second frame member.

104. The apparatus of the previous claim wherein: the first engagement feature bend in the second frame member is at least 90 degrees.

105. The apparatus of either of the previous two claims wherein: the first engagement feature bend in the second frame member is at least 135 degrees.

106. The apparatus of any of the previous tree claims wherein: the first engagement feature bend in the second frame member is no more than 180 degrees.

107. The apparatus of any of the previous four claims wherein: the second engagement feature comprises a second engagement feature bend in the second frame member.

108. The apparatus of the previous claim wherein: the second engagement feature bend in the second frame member is no more than 90 degrees.

109. The apparatus of either of the previous two claims wherein: the second engagement feature bend in the second frame member is at least 45 degrees.

110. The apparatus of any of the previous three claims wherein: the second engagement feature comprises a third engagement feature bend in the second frame member.

111. The apparatus of the previous claim wherein: the third engagement feature bend in the second frame member is no more than 90 degrees.

112. The apparatus of either of the previous two claims wherein: the third engagement feature bend in the second frame member is at least 45 degrees.

113. The apparatus of any of the previous three claims wherein: the third engagement feature bend in the second frame member, the second engagement feature bend in the second frame member, and the first engagement feature bend in the second frame member are all in substantially a same plane.

114. The apparatus of the previous claim wherein: the third engagement feature bend in the second frame member and the second engagement feature bend in the second frame member both bend in a substantially opposite direction from the first engagement feature bend in the second frame member.

115. The apparatus of either of the previous two claims wherein: the first engagement feature bend in the second frame member is between the second engagement feature bend in the second frame member and the third engagement feature bend in the second frame member.

116. The apparatus of any of the claims herein that include the second section of the second frame member and the second end of the third frame member, wherein: the second section of the second frame member is opposite the second end of the third frame member.

117. The apparatus of any of the claims herein that include the second section of the second frame member and the second end of the third frame member, wherein: the second section of the second frame member is diagonally opposite the second end of the third frame member.

118. The apparatus of any of the claims herein that include the first section of the second frame member and the second section of the second frame member wherein: the first section of the second frame member has a cut end opposite the second section of the second frame member.

119. The apparatus of any of the claims herein that include the third section of the second frame member and the second section of the second frame member wherein: the third section of the second frame member has a cut end opposite the second section of the second frame member.

120. The apparatus of any of the claims herein that include a cut end wherein: the cut end comprises an end bend.

121. The apparatus of the previous claim wherein: the end bend is substantially adjacent to the cut end.

122. The apparatus of the previous claim wherein: the end bend is adjacent to the cut end.

123. The apparatus of either of the previous two claims wherein: the end bend is at least 180 degrees.

124. The apparatus of the previous claim wherein: the end bend exceeds 180 degrees.

125. The apparatus of any of the claims herein that include the third frame member, wherein: the third frame member comprises:

a first section of the third frame member;

a second section of the third frame member; and a third section of the third frame member.

126. The apparatus of the previous claim wherein:

the first section of the third frame member is separated from the second section of the third frame member by a first bend in the third frame member; and the second section of the third frame member is separated from the third section of the third frame member by a second bend in the third frame member.

127. The apparatus of the previous claim wherein: the first bend in the third frame member is a substantially right angle.

128. The apparatus of the previous claim wherein: the second bend in the third frame member is a substantially right angle.

129. The apparatus of any of the claims herein that include the third frame member, wherein: the third frame member is monolithic.

130. The apparatus of any of the claims herein that include the third frame member, wherein: the third frame member comprises metal.

131. The apparatus of any of the claims herein that include the third frame member, wherein: the third frame member comprises steel.

132. The apparatus of any of the claims herein that include the third frame member, wherein: the third frame member comprises stainless steel.

133. The apparatus of any of the claims herein that include the third frame member, wherein: the third frame member has a solid cross section.

134. The apparatus of any of the claims herein that include the third frame member, wherein: the third frame member has a substantially round cross section.

135. The apparatus of any of the claims herein that include a first section of the third frame member and having a third section of the third frame member, wherein: the first section of the third frame member is substantially parallel to the third section of the third frame member.

136. The apparatus of any of the claims herein that include a first section of the third frame member and that include a third section of the third frame member, wherein:

the first section of the third frame member is substantially straight; and the third section of the third frame member is substantially straight.

137. The apparatus of any of the claims herein that include the first section of the third frame member and that include the third section of the third frame member, the apparatus further comprising: a mesh panel extending from the first section of the third frame member to the third section of the third frame member.

138. The apparatus of any of the claims herein that include the first section of the third frame member, the second section of the third frame member, and the third section of the third frame member, the third frame member further comprising: a fourth section of the third frame member.

139. The apparatus of the previous claim wherein: the fourth section of the third frame member is separated from the third section of the third frame member by a third bend in the third frame member.

140. The apparatus of the previous claim wherein: the third bend in the third frame member is a substantially right angle.

141. The apparatus of any of the previous three claims wherein: the fourth section of the third frame member is separated from the first section of the third frame member by a fourth bend in the third frame member.

142. The apparatus of the previous claim wherein: the fourth bend in the third frame member is a substantially right angle.

143. The apparatus of any of the claims herein that include the third frame member, wherein: the third frame member comprises two cut ends of the third frame member.

144. The apparatus of the previous claim, wherein: the two cut ends of the third frame member are substantially adjacent.

145. The apparatus of the previous claim, wherein: the two cut ends of the third frame member are adjacent.

146. The apparatus of either of the previous two claims, wherein: the third frame member comprises a joint that connects the two cut ends of the third frame member.

147. The apparatus of any of the previous three claims, wherein: the third frame member comprises a connector that connects the two cut ends of the third frame member.

148. The apparatus of any of the claims herein that include the fourth section of the third frame member and having the second section of the third frame member, wherein: the fourth section of the third frame member is substantially parallel to the second section of the third frame member.
149. The apparatus of any of the claims herein that include a second section of the third frame member wherein: the second section of the third frame member is curved.
150. The apparatus of any of the claims herein that include the second section of the third frame member wherein: the second section of the third frame member is at the second end of the third frame member.
151. The apparatus of any of the claims herein that include the fourth section of the third frame member wherein: the fourth section of the third frame member is at the first end of the third frame member.
152. The apparatus of any of the claims herein wherein: the apparatus is a bag for carrying items.
153. The apparatus of any of the claims herein wherein: the apparatus is a duffle bag for carrying items.
154. The apparatus of any of the claims herein wherein: the apparatus is a travel duffle.
155. The apparatus of any of the claims herein wherein: the apparatus is a backpack for carrying items on the back of a user.
156. The apparatus of any of the claims herein wherein: the apparatus is a daypack for carrying items on the back of a user.
157. The apparatus of any of the claims herein wherein: the apparatus is a child carrier.
158. The apparatus of any of the claims herein wherein: the apparatus is a baby carrier.
159. The apparatus of any of the claims herein wherein: the apparatus is a child carrier for carrying a child on the back of a user.
160. The apparatus of any of the claims herein wherein: the apparatus comprises a child harness for securing a child within the apparatus.
161. The apparatus of any of the claims herein wherein: the apparatus comprises a child seat for carrying a child within the apparatus.
162. The apparatus of any of the claims herein wherein: the apparatus comprises a carrying harness for attaching the apparatus to a back of a user.
163. The apparatus of the previous claim further comprising: a cover configured to cover the carrying harness while the apparatus is being shipped.
164. The apparatus of the previous claim further comprising: a zipper that secures the cover over the carrying harness while the apparatus is being shipped.
165. The apparatus of any of the claims herein that include the carrying harness and the third frame member wherein: the third frame member is substantially adjacent to the carrying harness.
166. The apparatus of any of the claims herein that include the carrying harness and the third frame member wherein: the carrying harness is attached to the third frame member.
167. The apparatus of any of the claims herein that include the carrying harness and the fabric body wherein: the carrying harness is attached to the fabric body.
168. The apparatus of any of the claims herein that include the carrying harness, the fabric body, and the third frame member wherein: the carrying harness is attached to the fabric body of the apparatus near third frame member
169. The apparatus of any of the claims herein further comprising: a first shoulder strap.
170. The apparatus of the previous claim further comprising: a second shoulder strap.
171. The apparatus of any of the claims herein further comprising: a hip belt.
172. The apparatus of any of the claims herein further comprising: two lifting straps.
173. The apparatus of the previous claim wherein: the two lifting straps are on opposite sides of the apparatus.
174. The apparatus of any of the claims herein further comprising: four lifting straps.
175. The apparatus of any of the claims herein further comprising: a fabric body.
176. The apparatus of any of the claims herein that include the fabric body, the apparatus further comprising: sleeves in the fabric body that contain the frame.
177. The apparatus of any of the claims herein that include the fabric body, the apparatus further comprising: sewn sleeves in the fabric body that contain the frame.
178. The apparatus of any of the claims herein that include the fabric body, wherein: the fabric body increases strength of the frame by supporting the frame.
179. The apparatus of any of the claims herein that include the fabric body, wherein: the fabric body increases compressive strength of the frame by supporting the frame against buckling.
180. The apparatus of the previous claim wherein: the frame is curved to control direction of the buckling to facilitate increasing the compressive strength of the frame by the fabric body.
181. The apparatus of any of the claims herein that include the fabric body wherein: the frame is within the fabric body.
182. The apparatus of any of the claims herein that include the fabric body, the apparatus further comprising: a first fastener connected to the fabric body wherein: the first fastener can be fastened to hold the frame in an uncollapsed configuration.
183. The apparatus of any of the claims herein that include the fabric body, the apparatus further comprising: a first fastener connected to the fabric body wherein, when the frame is expanded to an uncollapsed configuration, the first fastener can be fastened to hold the frame in the uncollapsed configuration.
184. The apparatus of any of the claims herein that include the fabric body and the first frame member wherein: the first frame member is within the fabric body.
185. The apparatus of any of the claims herein that include the fabric body and the second frame member wherein: the second frame member is within the fabric body.
186. The apparatus of any of the claims herein that include the fabric body and the third frame member wherein: the third frame member is within the fabric body.
187. The apparatus of any of the claims herein that include the first fastener wherein: the first fastener is unfastened before the frame is collapsed to a collapsed configuration.
188. The apparatus of any of the claims herein that include the first fastener wherein: the first fastener must be unfastened for the frame to be collapsed to the collapsed configuration.
189. The apparatus of any of the claims herein that include the first fastener wherein, when the first fastener is fastened, the first fastener holds the frame in the uncollapsed configuration.
190. The apparatus of any of the claims herein that include the first fastener wherein: the apparatus further comprises a second fastener wherein, when the frame is expanded to the uncollapsed configuration, the second fastener can be fastened to hold the frame in the uncollapsed configuration.

191. The apparatus of the previous claim wherein: the second fastener is unfastened before the frame is collapsed to the collapsed configuration.

192. The apparatus of either of the previous two claims wherein: the second fastener must be unfastened for the frame to be collapsed to the collapsed configuration.

193. The apparatus of any of the previous three claims wherein, when the second fastener is fastened, the second fastener holds the frame in the uncollapsed configuration.

194. The apparatus of any of the claims herein that include the first fastener and the second fastener, wherein:
the apparatus has a first side and a second side;
the second side is opposite the first side;
the first fastener is on the first side; and
the second fastener is on the second side.

195. The apparatus of the previous claim wherein:
the apparatus has a left side and a right side;
the left side is the first side; and
the right side is the second side.

196. The apparatus of any of the claims herein that include the second fastener, wherein: the second fastener comprises a strap.

197. The apparatus of any of the claims herein that include the second fastener wherein: the second fastener comprises a buckle.

198. The apparatus of any of the claims herein that include the second fastener wherein: the second fastener comprises a hook and loop fastener.

199. The apparatus of any of the claims herein that include the first fastener wherein: the first fastener comprises a strap.

200. The apparatus of any of the claims herein that include the first fastener wherein: the first fastener comprises a buckle.

201. The apparatus of any of the claims herein that include the first fastener wherein: the first fastener comprises a hook and loop fastener.

202. The apparatus of any of the claims herein that include a buckle wherein: the buckle is plastic.

203. The apparatus of any of the claims herein that include buckles wherein: the buckles are plastic.

204. The apparatus of any of the claims herein wherein: the apparatus is certified to conform with ASTM F2549-14a.

205. The apparatus of any of the claims herein wherein: the apparatus is certified to conform with EN 13209-1:2004.

206. The apparatus of any of the claims herein wherein: a contact point between two frame members is covered with fabric to protect a child's fingers from getting pinched between the two frame members.

207. The apparatus of any of the claims herein wherein: a contact point between two frame members is covered with fabric to help protect a child's fingers from getting caught between the two frame members.

208. The apparatus of any of the claims herein wherein: a contact point between two frame members is covered with fabric to protect a child's fingers from getting hurt between the two frame members.

209. The apparatus of any of the claims herein that include the first frame member and the second frame member wherein: a contact point between the first frame member and the second frame member is covered with fabric to protect a child's fingers from getting hurt between the first frame member and the second frame member.

210. The apparatus of any of the claims herein that include fabric to protect a child's fingers wherein: the fabric to protect the child's fingers is sewn.

211. The apparatus of any of the claims herein that include fabric to protect a child's fingers wherein: the fabric to protect the child's fingers is cone shaped.

212. The apparatus of any of the claims herein that include fabric to protect a child's fingers wherein: the fabric to protect the child's fingers is shaped like a truncated cone.

213. The apparatus of any of the claims herein that include fabric to protect a child's fingers wherein: the fabric to protect the child's fingers comprises a frustum.

214. The apparatus of any of the claims herein further comprising: a flap to protect a child's fingers from getting pinched between frame members.

215. The apparatus of any of the claims herein further comprising: a cover to protect a child's fingers from getting pinched between frame members.

216. The apparatus of any of the claims herein further comprising: a polymer cover to protect a child's fingers from getting pinched between frame members.

217. The apparatus of any of the claims herein further comprising: a plastic cover to protect a child's fingers from getting pinched between frame members.

218. The apparatus of any of the claims herein comprising the cover to protect a child's fingers from getting pinched between frame members wherein the cover is molded.

219. The apparatus of any of the claims herein wherein: the apparatus is configured to stand up when uncollapsed.

220. The apparatus of any of the claims herein wherein: the apparatus is configured to stand up when opened.

221. The apparatus of any of the claims herein wherein: the apparatus comprises a three-dimensional back panel.

222. The apparatus of any of the preceding claims wherein: the apparatus comprises a suspended trampoline back panel.

223. A piece of luggage for carrying items while traveling, the piece of luggage comprising: limitations of any combination of the claims herein.

224. The apparatus of any of the claims herein wherein: the apparatus comprises graphene.

225. The apparatus of any of the claims herein that include fabric wherein: the fabric comprises graphene.

226. The apparatus of any of the claims herein comprising a strap wherein: the strap comprises graphene.

227. The apparatus of any of the claims herein wherein: the apparatus comprises two wheels for rolling the apparatus on a flat surface.

228. The apparatus of any of the claims herein wherein: the apparatus comprises at least two wheels for rolling the apparatus on a flat surface.

229. The apparatus of any of the claims herein that include the third frame member wherein: the apparatus comprises two wheels for rolling the apparatus on a flat surface and the two wheels are attached to the apparatus near the third frame member.

230. The apparatus of any of the claims herein that include the third frame member wherein: the apparatus comprises two wheels for rolling the apparatus on a flat surface and the two wheels are attached to the third frame member.

231. The apparatus of any of the claims herein that include the second end of the third frame member wherein: the apparatus comprises two wheels for rolling the apparatus on a flat surface and the two wheels are located near the second end of the third frame member.

232. The apparatus of any of the claims herein that include the second end of the third frame member wherein: the apparatus comprises two wheels for rolling the apparatus on a flat surface and the two wheels are attached to the second end of the third frame member.

233. The apparatus of any of the claims herein that include the first frame member wherein: the apparatus comprises two wheels for rolling the apparatus on a flat surface and the two wheels are attached to the first frame member.

234. The apparatus of any of the claims herein that include the second section of the first frame member wherein: the apparatus comprises two wheels for rolling the apparatus on a flat surface and the two wheels are attached to the second section of the first frame member.

235. The apparatus of any of the claims herein that include the second frame member wherein: the apparatus comprises two wheels for rolling the apparatus on a flat surface and the two wheels are attached to the second frame member.

236. The apparatus of any of the claims herein wherein: the apparatus comprises four wheels for rolling the apparatus on a flat surface.

237. The apparatus of any of the claims herein wherein: the apparatus comprises a handle for rolling the apparatus on a flat surface.

238. The apparatus of any of the claims herein wherein: the apparatus comprises an extendable handle for rolling the apparatus on a flat surface.

239. The apparatus of any of the claims herein wherein: the apparatus comprises a telescoping handle for rolling the apparatus on a flat surface.

240. The apparatus of any of the claims herein that include the first frame member wherein: the first frame member has a U shape.

241. The apparatus of any of the claims herein that include the first frame member wherein, when the apparatus is upright, the first frame member has a U shape.

242. The apparatus of any of the claims herein that include the first frame member wherein: the first frame member has rounded corners.

243. The apparatus of any of the claims herein that include the second frame member wherein: the second frame member has a U shape.

244. The apparatus of any of the claims herein that include the second frame member wherein, when the apparatus is upright, the second frame member has an inverted U shape.

245. The apparatus of any of the claims herein that include the second frame member wherein: the second frame member has rounded corners.

246. The apparatus of any of the claims herein that include the third frame member wherein: the third frame member has a rectangular shape.

247. The apparatus of any of the claims herein that include the third frame member wherein, when the apparatus is upright, the third frame member has a rectangular shape.

248. The apparatus of any of the claims herein that include the third frame member wherein, when the apparatus is upright, the third frame member has a rectangular shape; the rectangular shape has a width and a height, and the height is greater than the width.

249. The apparatus of any of the claims herein that include the third frame member wherein: the third frame member has rounded corners.

250. The apparatus of any of the claims herein that include the frame wherein: the frame bends rather than breaking when an excessive force is applied to the frame.

251. The apparatus of any of the claims herein that include the frame wherein, when the apparatus is in an upright position on a flat surface and an excessive force is applied to a top of the apparatus, the frame bends rather than breaking.

252. The apparatus of any of the claims herein that include the frame wherein: the frame bends rather than buckling when an excessive force is applied to the frame.

253. The apparatus of any of the claims herein that include the frame wherein, when the apparatus is in an upright position on a flat surface and an excessive force is applied to a top of the apparatus, the frame bends rather than buckling.

254. The apparatus of any of the claims herein having the first engagement feature wherein the first engagement feature is formed by making at least one bend in the first frame member.

255. The apparatus of any of the claims herein having the first engagement feature wherein the first engagement feature comprises at least one bend in the first frame member.

256. The apparatus of any of the claims herein having the first engagement feature wherein the first engagement feature is formed by making multiple bends in the first frame member.

257. The apparatus of any of the claims herein having the first engagement feature wherein the first engagement feature is formed by making bends in substantially opposite directions in the first frame member.

258. The apparatus of any of the claims herein having the first engagement feature wherein the first engagement feature is formed by making substantially adjacent bends in the first frame member.

259. The apparatus of any of the claims herein having the first engagement feature wherein the first engagement feature is formed by making adjacent bends in the first frame member.

260. The apparatus of any of the claims herein having the second engagement feature wherein the second engagement feature is formed by making at least one bend in the second frame member.

261. The apparatus of any of the claims herein having the second engagement feature wherein the second engagement feature comprises at least one bend in the second frame member.

262. The apparatus of any of the claims herein having the second engagement feature wherein the second engagement feature is formed by making multiple bends in the second frame member.

263. The apparatus of any of the claims herein having the second engagement feature wherein the second engagement feature is formed by making bends in substantially opposite directions in the second frame member.

264. The apparatus of any of the claims herein having the second engagement feature wherein the second engagement feature is formed by making substantially adjacent bends in the second frame member.

265. The apparatus of any of the claims herein having the second engagement feature wherein the second engagement feature is formed by making adjacent bends in the second frame member.

266. The apparatus of any of the claims herein having the second engagement feature wherein the second engagement feature is formed by making three bends in the second frame member.

The invention claimed is:

1. An apparatus comprising: a collapsible frame comprising:

a frame assembly, wherein the frame assembly is moveable from at least a first configuration to a second configuration, the frame assembly comprising a first frame member having at least a first longitudinal arm with a first engagement member;

a second frame member having at least a corresponding second longitudinal arm that releasably engages with the first engagement member; and a third frame member having a pair of opposed longitudinal arms and a first transverse base located at a first end and a second transverse base located at a second end;

wherein, when the frame assembly moves from a first configuration to a second configuration, the longitudinal arm of the first frame member moves relative to the longitudinal arm of the second frame member until the first engagement feature engages the longitudinal arm of the second frame member;

the first frame member comprises at least a third longitudinal arm and a transverse member coupling the first longitudinal arm and the third longitudinal arm, wherein the first and third longitudinal arms have ends located proximal the first transverse base of the third frame member in both the first configuration and the second configuration; and the second frame member comprises at least a fourth longitudinal arm and a transverse member coupling the second longitudinal arm and the fourth longitudinal arm, wherein the second and fourth longitudinal arms have ends located proximal the second transverse base of the third frame member in both the first configuration and the second configuration.

2. The apparatus of claim 1 wherein the second frame member has a second engagement member on the longitudinal arm of the second frame member and the second frame member moves relative to the first frame member until the second engagement member engages the first engagement member.

3. The apparatus of claim 1 wherein the first frame member comprises a U shape and the second frame member comprises an inverted U shape with respect to the third frame member.

4. The apparatus of claim 1 wherein the first frame member rotates about an axis between the ends of the first and third longitudinal arms wherein the axis is proximal the first transverse base.

5. The apparatus of claim 4 wherein the second frame member rotates about an axis between the ends of the second and fourth longitudinal arms wherein the axis is proximal the second transverse base.

6. The apparatus of claim 5 wherein the first frame member and the second frame member rotate relative to the third frame member.

7. The apparatus of claim 1 comprising a fabric body wherein the frame assembly is contained within the fabric body.

8. The apparatus of claim 1 wherein the first configuration is at least a collapsed configuration and the second configuration is at least an expanded configuration.

9. An apparatus comprising:

a fabric body;

at least one fastener connected to the fabric body; and a collapsible frame assembly contained within the fabric body, the collapsible frame comprising:

a first frame member;

a second frame member; and a third frame member wherein the first frame member and the second frame member are movable from a collapsed position to an uncollapsed position with respect to the third frame member;

wherein, when the collapsible frame assembly is in the uncollapsed position, the at least one fastener can be fastened to hold the collapsible frame assembly in the uncollapsed position; and the first frame member has a transverse member that moves with respect to the third frame member when the first frame member rotates and the movement is stopped by the fabric body when the first frame member rotates to the uncollapsed position and the second frame member has a transverse member that moves with respect to the third frame member when the second frame member rotates and the movement is stopped by the fabric body when the second frame member rotates to the uncollapsed position.

10. The apparatus of claim 9 wherein the at least one fastener is a buckle comprising a male portion and a female portion.

11. The apparatus of claim 9 wherein the third frame member has a first transverse base and a second transverse base coupled by at least one longitudinal arm, and the first frame member rotates with respect to the third frame member about an axis substantially parallel to the first transverse base and the second frame member rotates with respect to the third frame member about an axis substantially parallel to the second transverse base.

12. The apparatus of claim 9 wherein the first frame member rotates with respect to the third frame member about a first axis, and the second frame member rotates with respect to the third frame member about a second axis;

the first frame member has at least one longitudinal arm extending from the first axis to the transverse member of the first frame member, and the longitudinal arm has at least one engagement member; and the second frame member has at least one longitudinal arm extending from the second axis to the transverse member of the second frame member, wherein when the first frame member and the second frame member move from the collapsed position to the uncollapsed position, the longitudinal arms slide until the longitudinal arm of the second frame member engages the at least one engagement member.

13. The apparatus of claim 9 wherein the first frame member rotates with respect to the third frame member about a first axis, and the second frame member rotates with respect to the third frame member about a second axis;

the second frame member has at least one longitudinal arm extending from the second axis to the transverse member of the first frame member and the longitudinal arm has at least one engagement member; and the first frame member has at least one longitudinal arm extending from the first axis to the transverse member of the second frame member, wherein when the first frame member and the second frame member move from the collapsed position to the uncollapsed position, the longitudinal arms slide until the longitudinal arm of the first frame member engages the at least one engagement member.

14. The apparatus of claim 9 wherein the fabric body comprises at least an inner panel and an outer panel defining a space therebetween and the frame assembly is contained within the space.

15. The apparatus of claim 14 wherein the fabric body further comprises a least one sleeve coupled to the fabric body and the frame assembly is contained with the at least one sleeve.

* * * * *